US006123517A

United States Patent [19]

Brooke et al.

[11] Patent Number: 6,123,517

[45] Date of Patent: Sep. 26, 2000

[54] SCROLL MACHINE WITH CAPACITY MODULATION

[75] Inventors: Richard D. Brooke, Sidney; Robert C. Stover, Versailles; Jean-Luc M. Caillat, Dayton, all of Ohio

[73] Assignee: Copeland Corporation, Sidney, Ohio

[21] Appl. No.: 08/979,339

[22] Filed: Nov. 24, 1997

[51] Int. Cl.[7] ..... F04B 49/02; F04C 18/02

[52] U.S. Cl. ..... 417/299; 417/310; 417/440

[58] Field of Search ..... 417/299, 310, 417/440

[56] References Cited

U.S. PATENT DOCUMENTS

| | | | |
|---|---|---|---|
| 4,383,805 | 5/1983 | Teegarden et al. | 417/308 |
| 4,456,435 | 6/1984 | Hiraga et al. | 417/302 |
| 4,468,178 | 8/1984 | Hiraga et al. | 417/440 |
| 4,497,615 | 2/1985 | Griffith | 417/310 |
| 4,514,150 | 4/1985 | Hiraga et al. | 417/440 |
| 4,566,863 | 1/1986 | Goto et al. | 417/295 |
| 4,673,340 | 6/1987 | Mabe et al. | 418/15 |
| 4,747,756 | 5/1988 | Sato et al. | 417/307 |
| 5,074,760 | 12/1991 | Hirooka et al. | 417/310 |
| 5,074,761 | 12/1991 | Hirooka et al. | 417/310 |
| 5,192,195 | 3/1993 | Iio et al. | 417/299 |
| 5,551,846 | 9/1996 | Taylor et al. | 417/308 |
| 5,562,426 | 10/1996 | Watanabe et al. | 417/310 |
| 5,607,228 | 3/1997 | Wallis et al. | 417/310 |
| 5,613,841 | 3/1997 | Bass et al. | 417/310 |
| 5,678,985 | 10/1997 | Brooke et al. | 417/229 |
| 5,741,120 | 4/1998 | Bass et al. | 417/44.2 |
| 5,803,716 | 9/1998 | Wallis et al. | 417/310 |
| 5,833,442 | 11/1998 | Park et al. | 418/1 |

*Primary Examiner*—Charles G. Freay
*Assistant Examiner*—Robert Z. Evora
*Attorney, Agent, or Firm*—Harness, Dickey & Pierce, P.L.C.

[57] ABSTRACT

A scroll-type refrigeration compressor is disclosed which incorporates an efficient, reliable, low cost modulation system employing a single actuator to effect switching between full and reduced capacity operation. The modulation system of the present invention includes an annular valving ring rotationally supported on the non-orbiting scroll or main bearing housing which operates to ensure simultaneous opening and closing of one or more unloading passages thus avoiding the possibility of even transient pressure imbalances between opposed compression pockets during operation of the compressor or in one of the alternative embodiments, providing a controlled imbalance to provide a noise reducing torsional loading on the Oldham coupling. Further, the modulation system of the present invention provides for reduced capacity at both start up and shut down thus enabling the use of more efficient lower starting torque motors and reducing the potential for noise generating reverse rotation on shut down. The valving ring may be actuated by either a single or double acting pressure actuated piston or by an electrically operated drive.

41 Claims, 13 Drawing Sheets

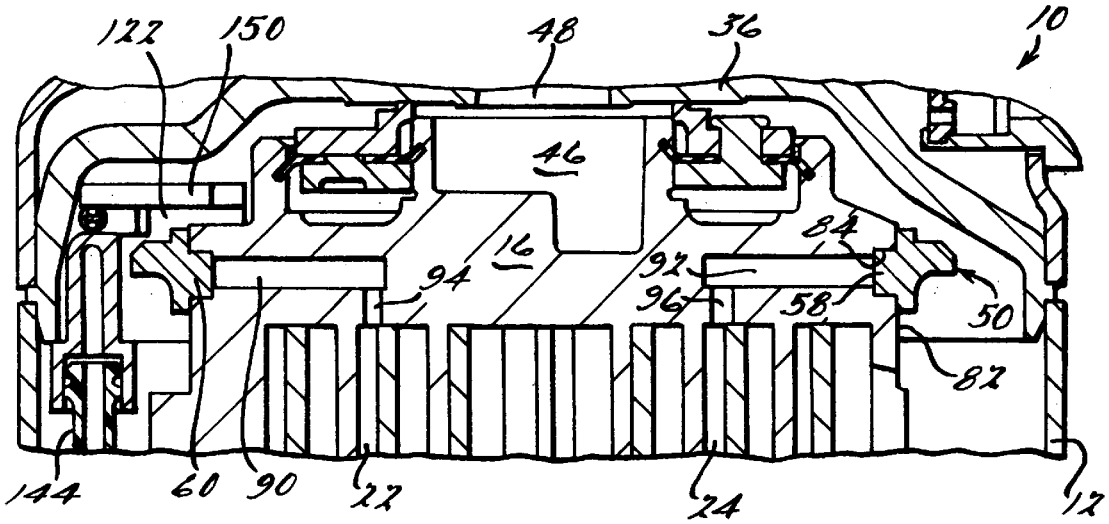
FIG. 2.
FIG. 3.
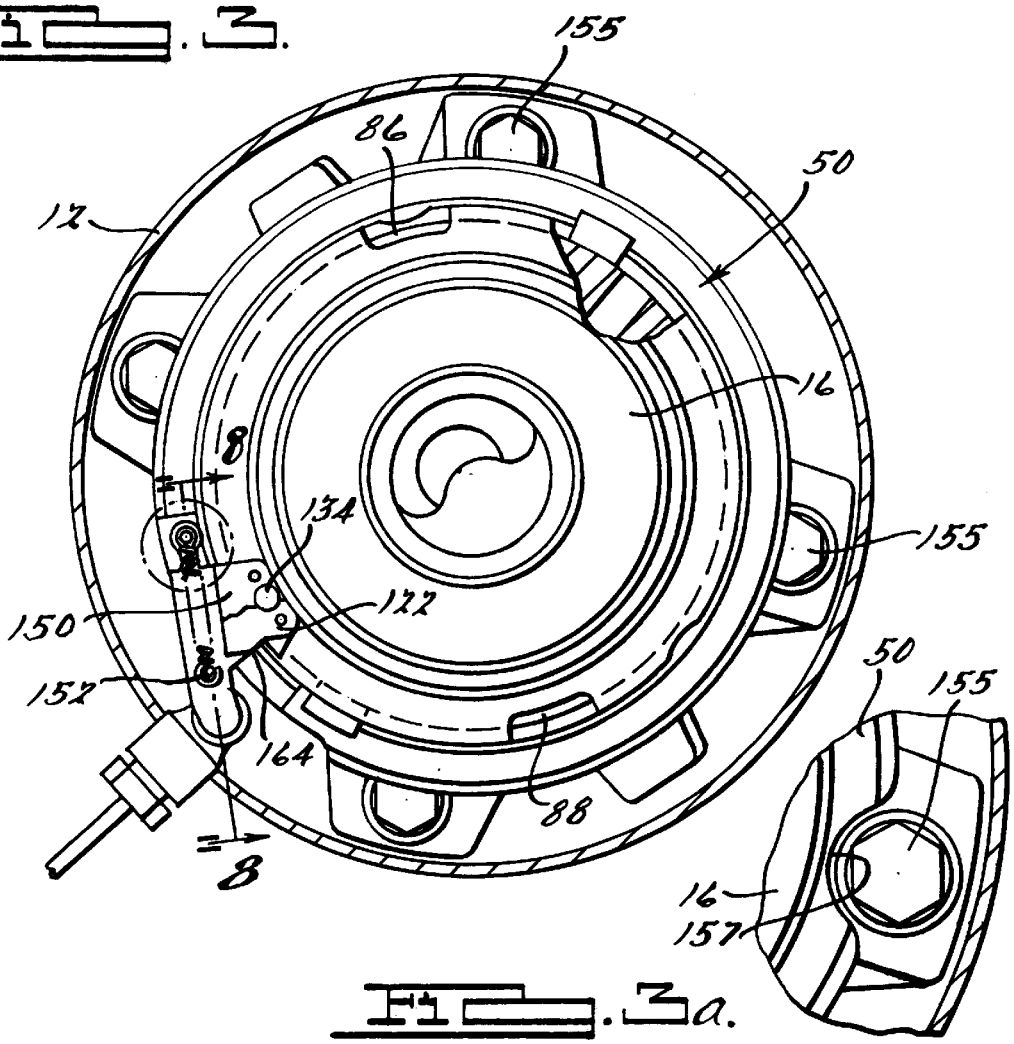
FIG. 3a.

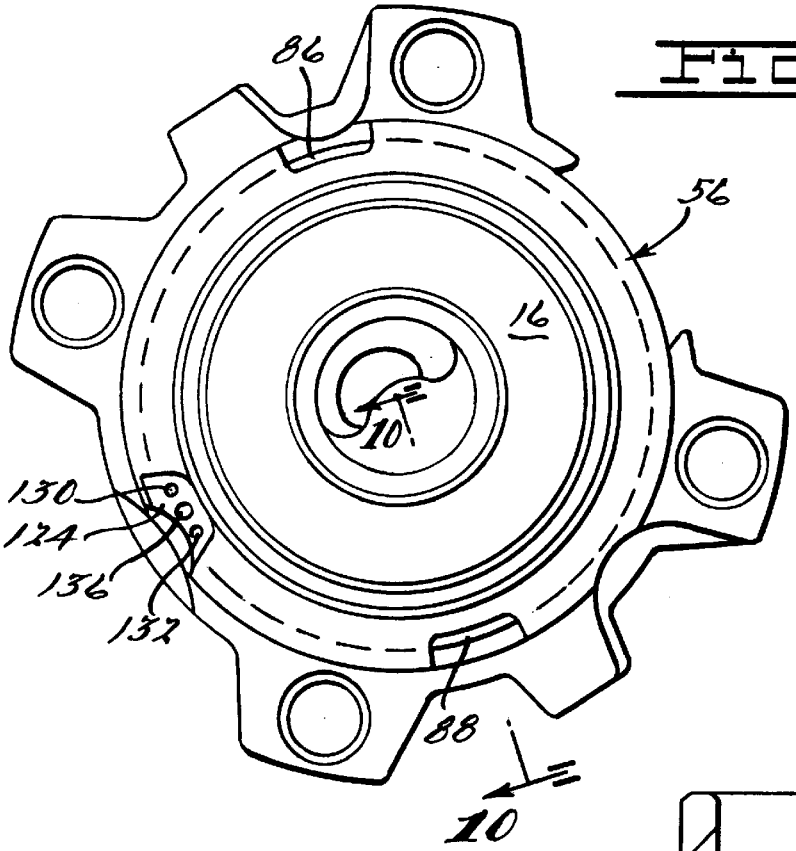
FIG. 9.
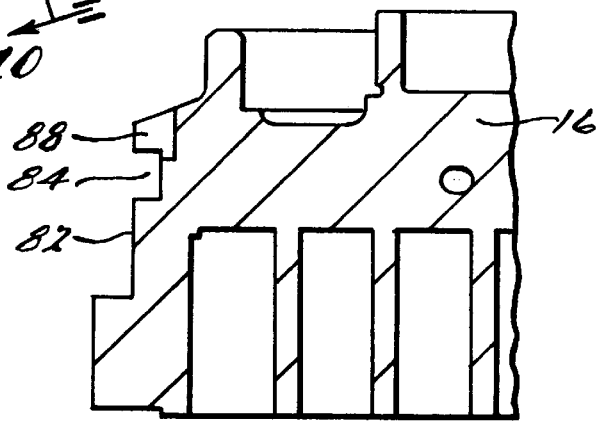
FIG. 10.
FIG. 11.
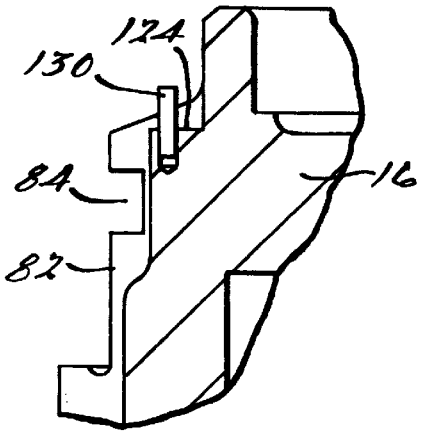
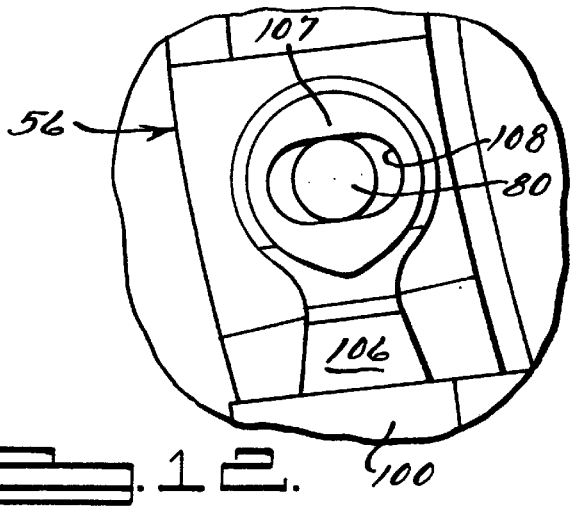
FIG. 12.

130
132
176
174

162"
160"

44"
170
42"
50"
20"
18"
12"
16"
92"
24"
14"
26"
172
32"
34"
36"
30"
96"
28"
48"
94"
40"
90"
22"
38"
52"
144"
140"
158"

Fig. 27.
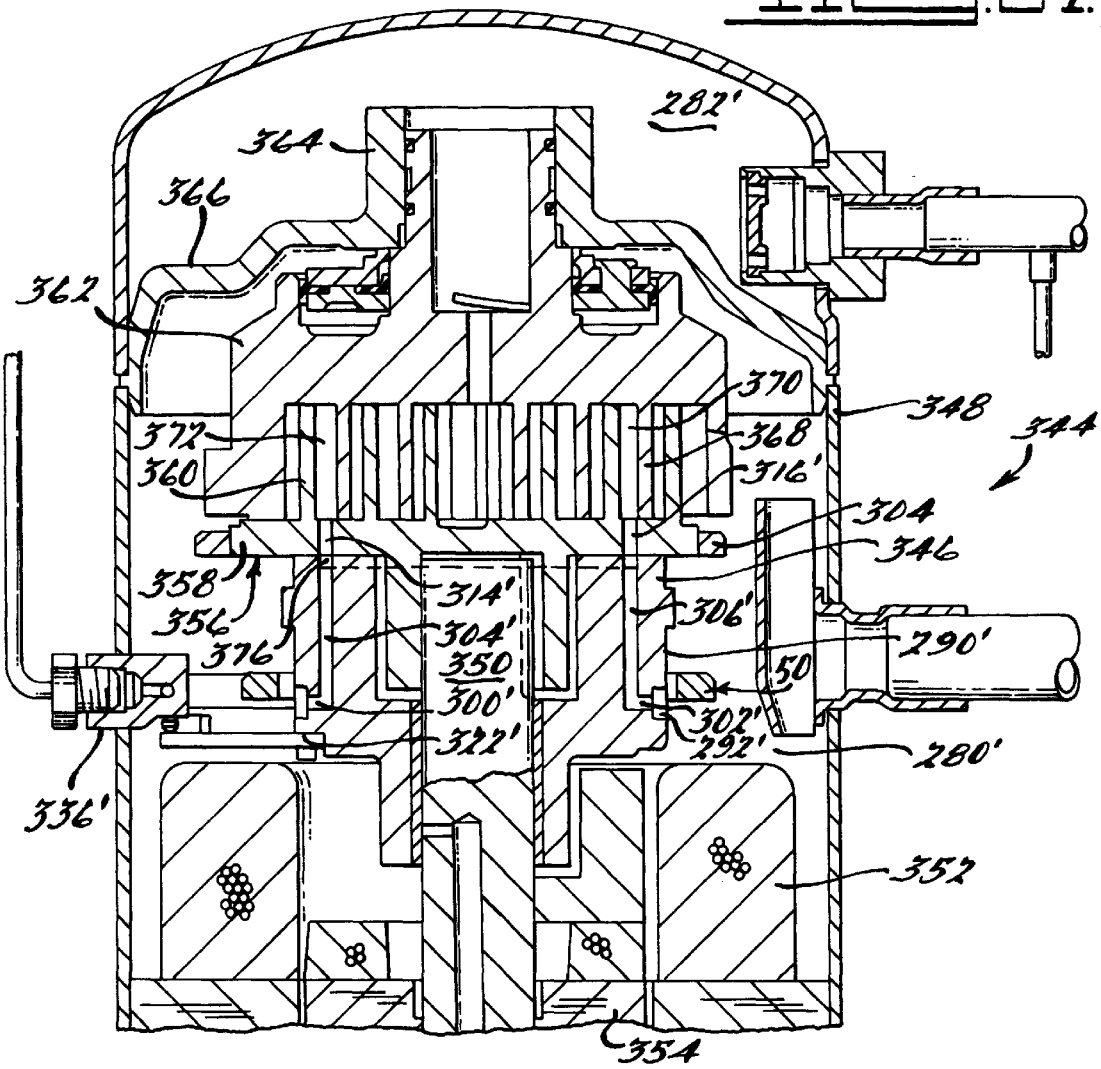
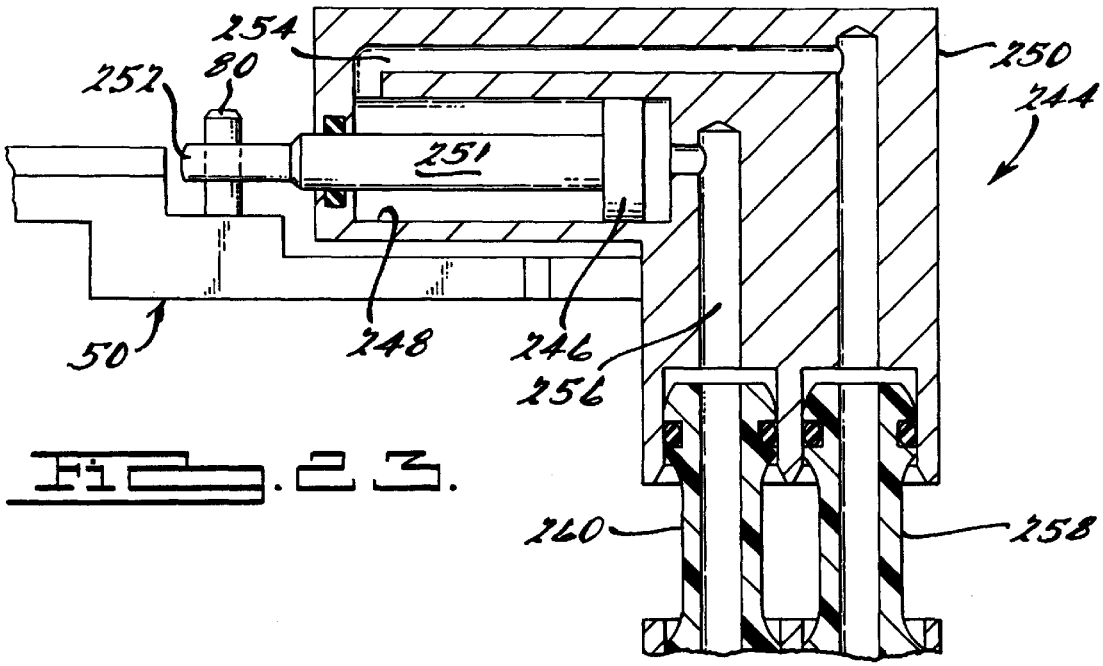
Fig. 23.

SCROLL MACHINE WITH CAPACITY MODULATION

CROSS REFERENCE TO RELATED APPLICATION

This application is related to U.S. Ser. No. 08/574,991, filed Dec. 19, 1995 now issued U.S. Pat. No. 5,678,985.

BACKGROUND AND SUMMARY OF THE INVENTION

The present invention relates generally to scroll compressors and more specifically to a capacity modulation system of the delayed suction type for such compressors.

Refrigeration and air conditioning systems are commonly operated under a wide range of loading conditions due to changing environmental conditions. In order to effectively and efficiently accomplish the desired cooling under such changing conditions, it is desirable to incorporate means to vary the capacity of the compressors utilized in such systems.

A wide variety of systems have been developed in order to accomplish this capacity modulation most of which delay the initial sealing point of the moving fluid pockets defined by scroll members. In one form, such systems commonly employ a pair of vent passages communicating between suction pressure and the outermost pair of moving fluid pockets. Typically these passages open into the moving fluid pockets at a position normally within 360° of the sealing point of the outer ends of the wraps. Some systems employ a separate valve member for each such vent passage which valves are intended to be operated simultaneously so as to ensure a pressure balance between the two fluid pockets. Other systems employ additional passages to place the two vent passages in fluid communication thereby enabling use of a single valve to control capacity modulation.

The first type of system mentioned above creates a possibility that the two valves may not operate simultaneously. For example, should one of the two valves fail, a pressure imbalance will be created between the two fluid pockets which will increase the stresses on the Oldham coupling thereby reducing the life of the compressor. Further, such pressure imbalance may result in increasing operating noise to an unacceptable level. Even slight differences in the speed of operation between the two valves can result in objectionable noise generating transient pressure imbalances.

While the second type of system mentioned above eliminates the concern over pressure imbalances encountered with the first system, it requires additional costly machining to provide a linking passage across the scroll end plate to interconnect the two vent passages. Additionally, the addition of this linking passage increases the re-expansion volume of the compressor when it is operated in a full capacity mode thus reducing its efficiency.

The present invention, however, overcomes these and other problems by providing a single valving ring operated by a single actuator so as to ensure simultaneous opening and closing of the vent passages thus avoiding any possibility of even transient pressure imbalances in the fluid pockets. In one embodiment, the valving ring of the present invention is in the form of an annular ring which is rotatably mounted on the non-orbiting scroll member and includes portions operative to open and close, one, two or more vent passages simultaneously. In one form a single actuator is provided which is operative to move the valving member preferably from an open reduced capacity position to a closed position and a return spring operates to return the valving member to a preferred open position. In another form, the return spring is omitted and the actuator operates to drive the valving member between the open and closed positions through application of either fluid pressure or electrically. In a second embodiment, the valving ring is supported on the main bearing housing and passages are provided therein which communicate with the compression chambers via openings in the end plate of the orbiting scroll member.

For any of these embodiments, a minimum number of parts are required to accomplish the capacity modulation. Further, the capacity modulation system of the present invention will preferably be designed such that the compressor will be in a reduced capacity mode at both start up and shut down. The reduced capacity starting mode reduces the required starting torque because the compressor is compressing a substantially smaller volume of refrigerant. This reduced starting torque enables use of a lower torque higher efficiency motor. Also, reduced capacity operation at shut down reduces the potential and degree of noise generating reverse rotation of the scrolls thereby enhancing customer satisfaction. Additionally, the system of the present invention is designed such that should the actuating system fail, the compressor will be able to continue operation in a reduced or modulated capacity mode. This is desirable because under normally encountered operating conditions, the compressor will spend most of its running time in the modulated or reduced capacity mode.

Additional advantages and features of the present invention will become apparent from the subsequent description and the appended claims taken in conjunction with the accompanying drawings.

BRIEF DESCRIPTION OF THE DRAWINGS

FIG. 2 is an enlarged view of a portion of the compressor shown in FIG. 1 with the valving ring shown in a closed position;

FIG. 3 is a plan view of the compressor shown in FIG. 1 with the top portion of the outer shell removed;

FIG. 9 is a plan view of the non-orbiting scroll with the valving ring removed therefrom, all in accordance with the present invention;

FIG. 10 is a fragmentary section view of the non-orbiting scroll shown in FIG. 9, the section being taken along line 10—10 thereof;

FIG. 11 is an enlarged detail view of a portion of the non-orbiting scroll shown in FIG. 9;

FIG. 12 is an enlarged detail view showing the interconnection between the actuating assembly and the valving ring, all in accordance with the present invention;

FIG. 13 is a fragmentary section view similar to FIG. 1 but showing another embodiment of the present invention;

FIG. 23 is a view similar to that of FIG. 8 but showing a further alternative actuating assembly all in accordance with the present invention;

FIG. 27 is a view similar to that of FIG. 24 showing another embodiment of the present invention.

DESCRIPTION OF THE PREFERRED EMBODIMENTS

Figure 1:
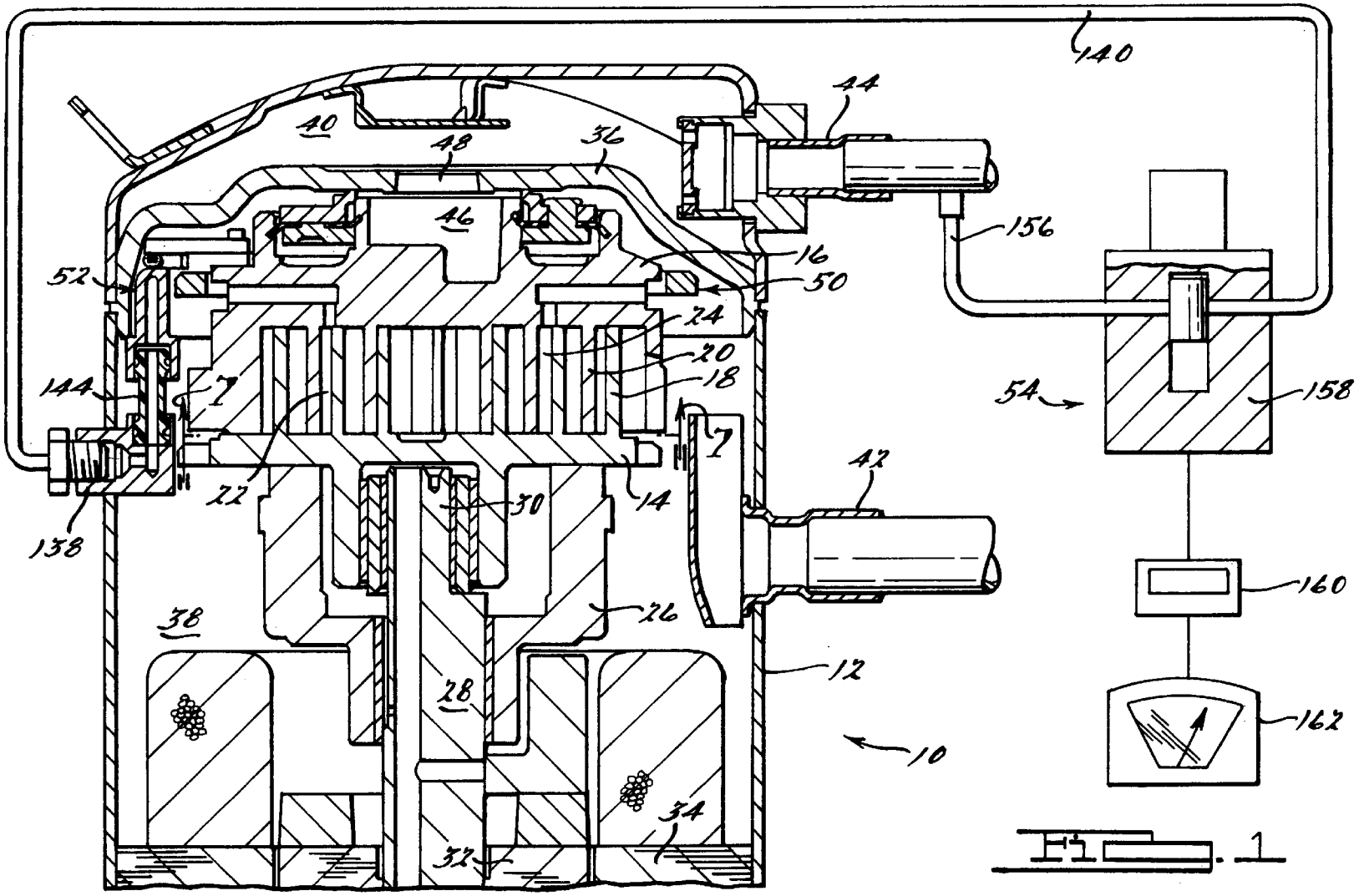
FIG. 1 is a fragmentary section view of a hermetic scroll compressor incorporating the capacity modulation system of the present invention.
Figure 4:
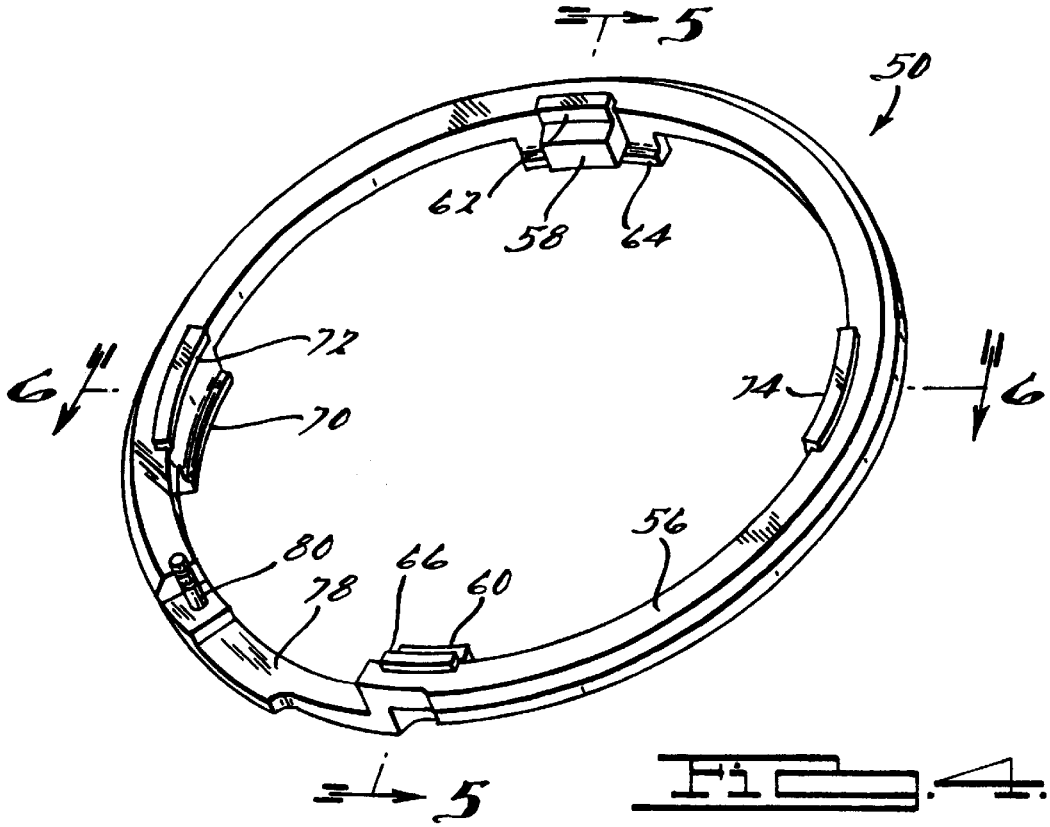
FIG. 4 is a perspective view of the valving ring incorporated in the compressor of FIG. 1.
Figure 5:
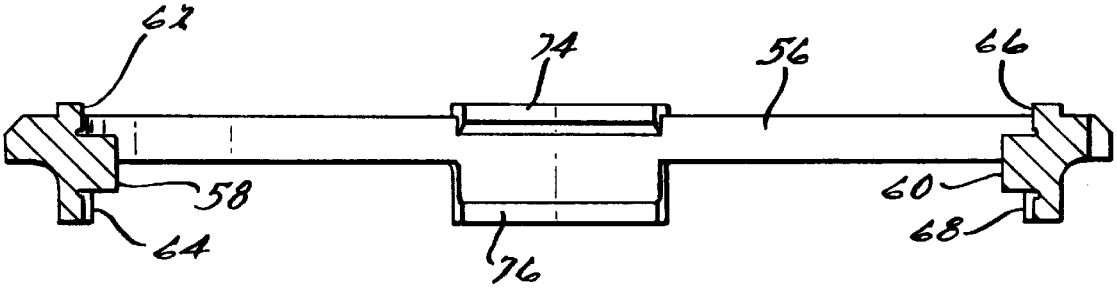
FIGS. 5 and 6 are section views of the valving ring of FIG. 4, the sections being taken along lines 5—5 and 6—6 thereof, respectively.
Figure 6:
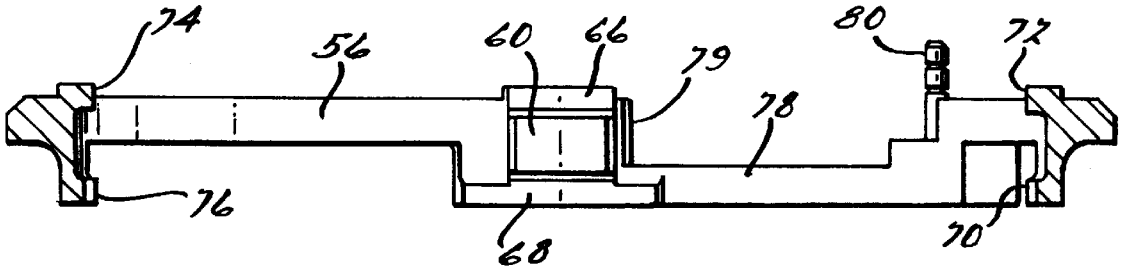
Figure 7:
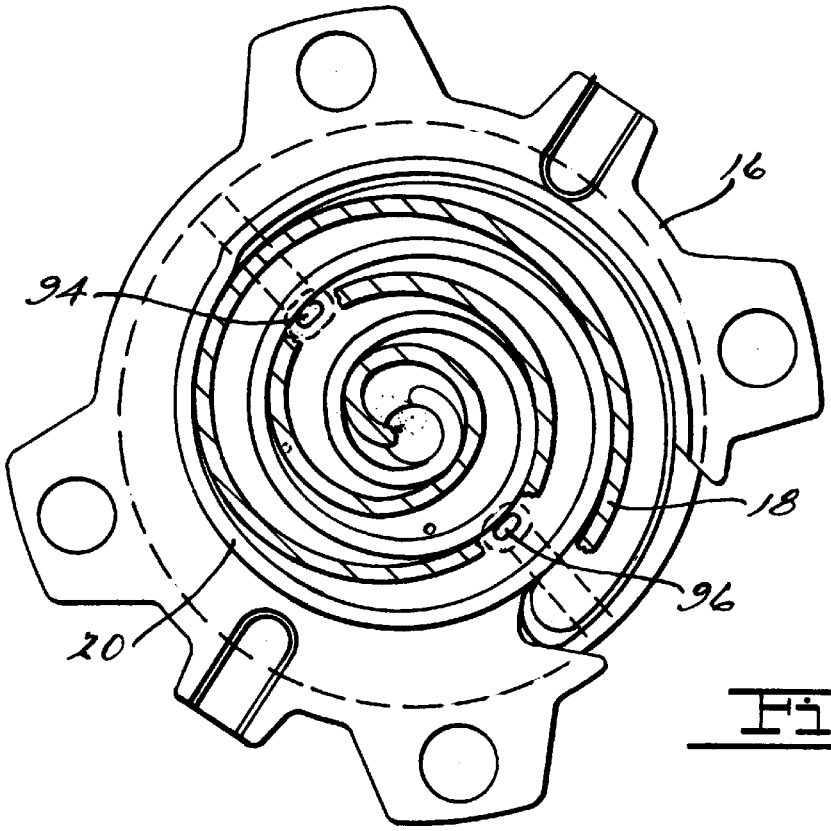
FIG. 7 is a fragmentary section view showing the scroll assembly forming a part of the compressor of FIG. 1, the section being taken along line 7—7 thereof.

Referring now to the drawings and in particular to FIG. 1, there is shown a hermetic scroll-type refrigeration compressor indicated generally at 10 and incorporating a capacity modulation system in accordance with the present invention.

Compressor 10 is generally of the type disclosed in U.S. Pat. No. 4,767,293 issued Aug. 30, 1988 and assigned to the same assignee as the present application the disclosure of which is hereby incorporated by reference. Compressor 10 includes an outer shell 12 within which is disposed orbiting and non-orbiting scroll members 14 and 16 each of which include upstanding interleaved spiral wraps 18 and 20 which define moving fluid pockets 22, 24 which progressively decrease in size as they move inwardly from the outer periphery of the scroll members 14 and 16.

A main bearing housing 26 is provided which is supported by outer shell 12 and which in turn movably supports orbiting scroll member 14 for relative orbital movement with respect to non-orbiting scroll member 16. Non-orbiting scroll member 16 is supported by and secured to main bearing housing for limited axial movement with respect thereto in a suitable manner such as disclosed in U.S. Pat. No. 5,407,335 issued Apr. 18, 1995 and assigned to the same assignee as the present application, the disclosure of which is hereby incorporated by reference.

A drive shaft 28 is rotatably supported by main bearing housing 26 and includes an eccentric pin 30 at the upper end thereof drivingly connected to orbiting scroll member 14. A motor rotor 32 is secured to the lower end of drive shaft 28 and cooperates with a stator 34 supported by outer shell 12 to rotatably drive shaft 28.

Outer shell 12 includes a muffler plate 36 which divides the interior thereof into a first lower chamber 38 at substantially suction pressure and an upper chamber 40 at discharge pressure. A suction inlet 42 is provided opening into lower chamber 38 for supplying refrigerant for compression and a discharge outlet 44 is provided from discharge chamber 40 to direct compressed refrigerant to the refrigeration system.

As thus far described, scroll compressor 12 is typical of such scroll-type refrigeration compressors. In operation, suction gas directed to lower chamber 38 via suction inlet 42 is drawn into the moving fluid pockets 22 and 24 as orbiting scroll member 14 orbits with respect to non-orbiting scroll member 16. As the moving fluid pockets 22 and 24 move inwardly, this suction gas is compressed and subsequently discharged into discharge chamber 40 via a center discharge passage 46 in non-orbiting scroll member 16 and discharge opening 48 in muffler plate 36. Compressed refrigerant is then supplied to the refrigeration system via discharge outlet 44.

In selecting a refrigeration compressor for a particular application, one would normally choose a compressor having sufficient capacity to provide adequate refrigerant flow for the most adverse operating conditions to be anticipated for that application and may select a slightly larger capacity to provide an extra margin of safety. However, such "worst case" adverse conditions are rarely encountered during actual operation and thus this excess capacity of the compressor results in operation of the compressor under lightly loaded conditions for a high percentage of its operating time. Such operation results in reducing overall operating efficiency of the system. Accordingly, in order to improve the overall operating efficiency under generally encountered operating conditions while still enabling the refrigeration compressor to accommodate the "worst case" operating conditions, compressor 10 is provided with a capacity modulation system.

The capacity modulation system of the present invention includes an annular valving ring 50 movably mounted on non-orbiting scroll member 16, an actuating assembly 52 also supported on non-orbiting scroll member 16 and a control system 54 for controlling operation of the actuating assembly.

As best seen with reference to FIGS. 2 and 4 through 6, valving ring 50 comprises a generally circularly shaped main body portion 56 having a pair of substantially diametrically opposed radially inwardly extending protrusions 58 and 60 provided thereon of substantially identical predetermined axial and circumferential dimensions. Suitable substantially identical circumferentially extending guide surfaces 62, 64 and 66, 68 are provided adjacent axially opposite sides of protrusions 58 and 60, respectively. Additionally, two pairs of substantially identical circumferentially extending axially spaced guide surfaces 70, 72 and 74, 76 are provided on main body 56 being positioned in substantially diametrically opposed relationship to each other and spaced circumferentially approximately 90° from respective protrusions 58 and 60. As shown, guide surfaces 72 and 74 project radially inwardly slightly from main body 56 as do guide surfaces 62 and 66. Preferably, guide surfaces 72, 74 and 62, 66 are all axially aligned and lie along the periphery of a circle of a radius slightly less than the radius of main body 56. Similarly, guide surfaces 70 and 76 project radially inwardly slightly from main body 56 as do guide surfaces 64 and 68 with which they are preferably axially aligned. Also surfaces 70, 76 and 64, 68 lie along the periphery of a circle of a radius slightly less than the radius of main body 56 and preferably substantially equal to the radius of the circle along which surfaces 72, 74 and 62, 66 lie. Main body 56 also includes a circumferentially extending stepped portion 78 which includes an axially extending circumferentially facing stop surface 79 at one end. Step portion 78 is positioned between protrusion 60 and guide surfaces 70, 72. A pin member 80 is also provided extending axially upwardly adjacent one end of stepped portion 78. Valving ring 50 may be fabricated from a suitable metal such as aluminum or alternatively may be formed from a suitable polymeric composition and pin 80 may be either pressed into a suitable opening provided therein or integrally formed therewith.

As previously mentioned, valving ring 50 is designed to be movably mounted on non-orbiting scroll member 16. In order to accommodate valving ring 50, non-orbiting scroll member 16 includes a radially outwardly facing cylindrical sidewall portion 82 thereon having an annular groove 84 formed therein adjacent the upper end thereof. In order to enable valving ring 50 to be assembled to non-orbiting scroll member 16, a pair of diametrically opposed substantially identical radially inwardly extending notches 86 and 88 are provided in non-orbiting scroll member 16 each opening into groove 84 as best seen with reference to FIG. 3. Notches 86 and 88 have a circumferentially extending dimension slightly larger than the circumferential extent of protrusions 58 and 60 on valving ring 50.

Groove 84 is sized to movably accommodate protrusions 58 and 60 when valving ring is assembled thereto and notches 86 and 88 are sized to enable protrusions to be moved into groove 84. Additionally, cylindrical portion 82 will have a diameter such that guide surfaces 62, 64, 66, 68, 70, 72, 74 and 76 will slidingly support rotary movement of valving ring 50 with respect to non-orbiting scroll member 16.

Non-orbiting scroll member 16 also includes a pair of generally diametrically opposed radially extending passages 90 and 92 opening into the inner surface of groove 84 and extending generally radially inwardly through the end plate of non-orbiting scroll member 16. An axially extending passage 94 places the inner end of passage 90 in fluid communication with moving fluid pocket 22 while a second axially extending passage 96 places the inner end of passage 92 in fluid communication with moving fluid pocket 24. Preferably, passages 94 and 96 will be oval in shape so as to maximize the size of the opening thereof without having a width greater than the width of the wrap of the orbiting scroll member 14. Passage 94 is positioned adjacent an inner sidewall surface of scroll wrap 20 and passage 96 is positioned adjacent an outer sidewall surface of wrap 20. Alternatively passages 94 and 96 may be round if desired however the diameter thereof should be such that the opening does not extend to the radially inner side of the orbiting scroll member 14 as it passes thereover.

Figure 8:
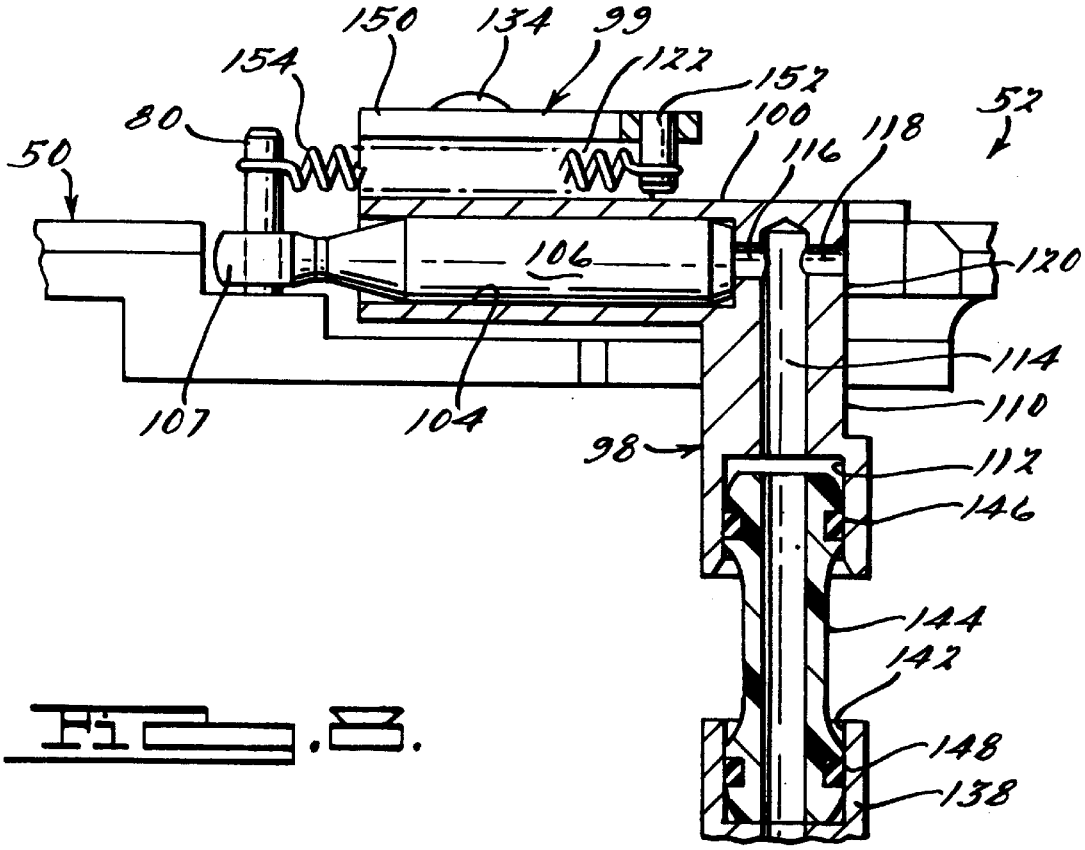
FIG. 8 is an enlarged view of the actuating assembly incorporated in the compressor of FIG. 1, all in accordance with the present invention.

Actuating assembly 52 includes a piston and cylinder assembly 98 and a return spring assembly 99. Piston and cylinder assembly 98 includes a housing 100 having a bore defining a cylinder 104 extending inwardly from one end thereof and within which a piston 106 is movably disposed. An outer end 107 of piston 106 projects axially outwardly from one end of housing 100 and includes an elongated opening 108 therein adapted to receive pin 80 forming a part of valving ring 50. Elongated or oval opening 108 is designed to accommodate the arcuate movement of pin 80 relative to the linear movement of piston end 107 during operation. A depending portion 110 of housing 100 includes an enlarged diameter opening 112 therein from which a fluid passage 114 extends upwardly as shown in FIG. 8. Fluid passage 114 intersects a laterally extending passage 116 which opens into the end of cylinder. A second relatively small laterally extending passage 118 extends from fluid passage 114 in the opposite direction of fluid passage 116 and opens outwardly through an end wall 120 of housing 100. Housing 100 also includes a mounting flange 122 integrally formed therewith and projecting upwardly and laterally outwardly therefrom. Mounting flange 122 is adapted to be seated on flat 124 provided on non-orbiting scroll member 16 and includes a pair of spaced openings 126,128 for receiving locating pins 130 and 132 respectively and a center opening for receiving a suitable securing threaded fastener 134 which is received in threaded bore 136 in non-orbiting scroll member 16. As shown in FIG. 11, locating pins 130 and 132 will initially be press fitted into suitable openings provided on flat 124 of non-orbiting scroll member 16 and serve to retain housing 100 in proper position both during assembly as well as in operation thereby eliminating the need for multiple threaded fasteners to secure same.

A suitable generally L-shaped fitting 138 is secured to shell 12 and extends outwardly therethrough the outer end being adapted for connection to a fluid line 140. An enlarged diameter opening 142 is provided in fitting 138 and is adapted to receive one end of a resilient fluid coupling 144. The opposite end of fluid coupling 144 is receiving in enlarged diameter opening 112 provided in housing 100 whereby fluid may be directed from fluid line 140 through fitting 138 and coupling 144 into cylinder 104 in housing 100. Suitable seals such as O-rings 146 and 148 may be provided adjacent opposite ends of coupling 144 to ensure a fluid tight sealing relationship with enlarged diameter openings 112 and 142. It should be noted that fluid coupling 144 is of a resilient material and is slidingly fitted within openings 112 and 142 so as to accommodate the slight axial movement of non-orbiting scroll member 16 due to its axial compliant mounting arrangement.

Return spring assembly 99 includes a retainer plate 150 adapted to overlie and abut mounting flange 122 of housing 100. Retainer plate also includes a pair of spaced openings to accommodate locating pins 130 and 132 and a center opening to accommodate threaded fastener 134 which serves to secure both retaining plate 150 and housing 100 to non-orbiting scroll member 16. As noted above, the use of locating pins 130 and 132 serves to maintain retainer plate in position during operation while eliminating the need for multiple threaded fasteners. Retaining plate 150 extends into overlying spaced relationship with respect to housing 100 and includes a depending pin 152 to which one end of a helical coil spring 154 is secured. The opposite end of spring 154 is secured to upstanding pin 80 provided on valving ring 50.

Valving ring 50 may be easily assembled to non-orbiting scroll member 16 by merely aligning protrusions 58 and 60 with respective notches 86 and 88 and moving protrusions 58 and 60 into annular groove 84. Thereafter valving ring 50 is rotated into the desired position with the axially upper and lower surfaces of protrusions 58 and 60 cooperating with guide surfaces 62, 64, 66, 68, 70, 72, 74 and 76 to movably support valving ring 50 on non-orbiting scroll member 50. Thereafter, housing 100 of actuating assembly 52 may be positioned on locating pins 130 and 132 with piston end 107 receiving pin 80. One end of spring 154 may then be connected to pin 152 and retainer plate assembled to locating pins 130, 132 and threaded fastener 134 installed. Thereafter, the other end of spring 154 may be connected to pin 80 thus completing the assembly process.

While, as described above, non-orbiting scroll member 16 is secured to main bearing housing 26 by suitable bolts 155 prior to assembly of valving ring 50 and actuating assembly 52, it may in some cases be preferable to assemble these capacity modulation components to non-orbiting scroll member 16 prior to assembly of non-orbiting scroll member 16 to main bearing housing 26. This may be easily accomplished by merely providing a plurality of suitably positioned arcuate cutouts 157 along the periphery of valving ring 50 which cutouts will afford access to securing bolts 155 with valving ring assembled to non-orbiting scroll member 16. Such a modification is shown in FIG. 3*a*.

Referring once again to FIG. 1, control system 54 includes a fluid line 156 having one end connected to discharge outlet 44 and the other end connected to a two way solenoid valve 158. Fluid line 140 forming a part of the control system is also connected to solenoid valve 158. A control module 160 is provided which serves to control operation of solenoid valve 158 in response to system operating conditions such as in response to signals received from thermostat 162.

In operation, control module 160 will ensure that solenoid valve 158 is in a closed position thereby preventing fluid communication between fluid lines 156 and 140 during start up of the compressor. As a result, cylinder 104 of actuating assembly 52 will be vented to suction pressure in chamber 38 via passages 116 and 118 thus enabling the force exerted by return spring 154 to maintain valving ring 50 in a position such as shown in FIG. 1 in which protrusions 58 and 60 are circumferentially displaced from passages 90 and 92. Thus, moving fluid pockets 22 and 24 will remain in fluid communication with lower chamber 38 at suction pressure via passages 94, 90 and 96, 92 after the initial sealing of the flank surfaces of the scroll wraps at the outer end thereof until such time as the moving fluid pockets have moved inwardly to a point at which they are no longer in fluid communication with passages 94 and 96. Thus, when valving ring 50 is in a position such that fluid passages 90 and 92 are in open communication with the suction gas chamber 38, the effective working length of scroll wraps 18 and 20 is reduced as is the compression ratio and hence capacity of the compressor. It should be noted that the degree of modulation or reduction in compressor capacity may be selected within a given range based upon the positioning of passages 94 and 96. These passages may be located so that they are in communication with the respective suction pockets at any point up to 360° inwardly from the point at which the trailing flank surfaces move into sealing engagement. If they are located further inwardly than this, compression of the fluid in the pockets will have begun and hence venting thereof will result in lost work and a reduction in efficiency.

It should also be noted that by ensuring passages 90 and 92 are in open communication with suction pressure at start up, the required starting torque for the compressor is substantially reduced. This enables the use of a more efficient lower starting torque motor, thus further contributing to overall system efficiency.

In any event, so long as system conditions as received by control module 160 indicate, compressor 10 will continue to operate in this reduced capacity mode. However, should system conditions dictate that additional capacity is required such as may be indicated by a signal from thermostat 162 to controller 160, controller 160 will actuate solenoid valve 158 to an open position thus directing fluid at discharge pressure from discharge outlet 44 to cylinder 104 via fluid lines 156,140, fitting 158, coupling 144 and passages 114 and 116. The force resulting from the supplying of discharge pressure fluid to cylinder 104 will overcome the force exerted by spring 154 thereby driving piston 106 outwardly from cylinder 104 and causing valving ring to rotate in a clockwise direction as shown in FIG. 3 until stop surface 79 moves into engagement with abutment surface 164 provided on housing 100. With valving ring 50 in this position, protrusions 58 and 60 will have been moved along groove 84 to a position as shown in FIG. 2 in which they overlie and close off passages 92 and 90 respectively thus preventing further venting of the suction fluid pockets therethrough and increasing the capacity of compressor 10 to its full rated capacity. So long as system operating conditions require, solenoid valve will be maintained in its energized open position thereby maintaining the supply of discharge fluid pressure to cylinder 104 to retain piston 106 in its extended position and hence compressor 10 at its full rated capacity.

Once system conditions indicate a return to reduced modulated capacity operation is warranted, control module 160 will de-energize solenoid 158 thereby closing off fluid communication between lines 156 and 140. The discharge fluid pressure in lines 140 as well as in cylinder 104 will then be vented to the suction pressure in chamber 38 via passage 118 thus allowing spring 154 to return actuating ring 50 to its initial position wherein passages 90 and 92 are in open fluid communication with chamber 38 at substantially suction pressure.

It should be noted that because protrusions 58 and 60 are provided on one annular ring, simultaneous opening and closing of passages 92 and 90 is assured. This ensures that not even transient pressure imbalances will occur between the two moving suction fluid pockets which could result in increased stress, wear, and/or operating noise. Further, it should be noted that because the solenoid valve is selected to be in a normally closed position, failure of either the solenoid valve or control module will not prevent continued operation of the compressor. This feature facilitates the use of a higher efficiency low starting torque motor which most likely would not be able to start the compressor in a full capacity operating mode. Additionally, the modulation system of the present invention will preferably be designed to return the compressor to a reduced modulated capacity mode of operation at shut down which serves to reduce shut down noise due to reverse rotation.

While the modulation system of the present invention described above provides an extremely efficient positive acting means for controlling the capacity of the compressor, the continuous venting of discharge gas to suction via vent passage 118 may in some applications be undesirable and/or may also reduce the speed of switching between modulated and full capacity operation. Accordingly, a preferred modified embodiment of the present invention is shown in FIGS. 13 and 14 in which vent passage 118 has been omitted.

In this preferred embodiment, a three-way solenoid valve 166 is used in place of two-way solenoid valve 158 and a fluid line 168 is provided connecting solenoid valve 166 to the suction inlet 42'. The remaining portions of the compressor and modulation system are the same as previously described and hence indicated by the same numbers primed. Further, the operation of this embodiment will be substantially identical to that described above with the exception that when compressor 10' is operating in the reduced capacity mode, solenoid valve will be in a de-energized position in which fluid line 140' will be in fluid communication with the suction inlet 42' via fluid line 168.

Figures 14, 15:
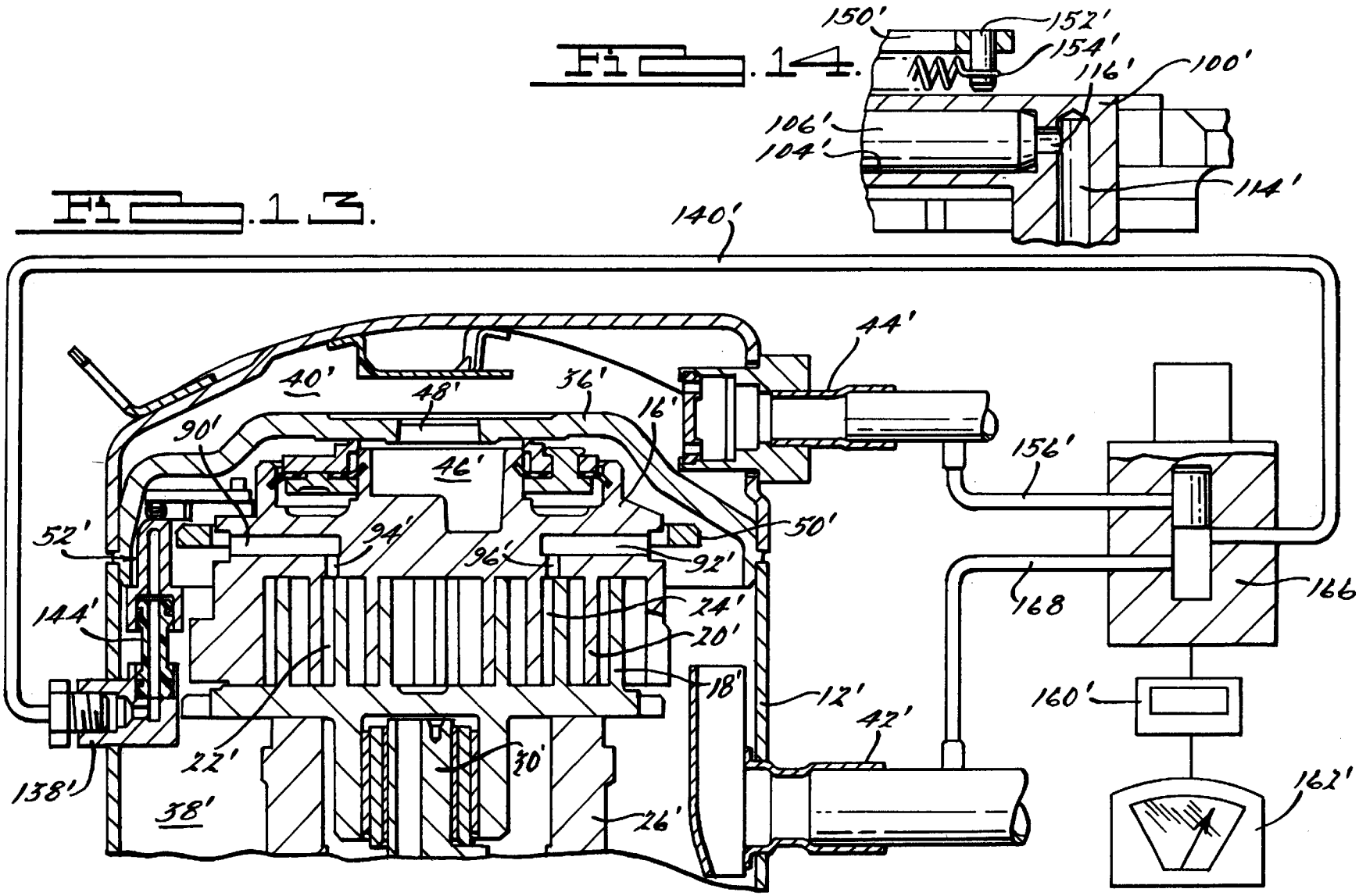
FIG. 14 is an enlarged detail view of the actuating assembly incorporated in the embodiment shown in FIG. 13.
FIG. 15 is a fragmentary section view similar to that of FIG. 1 but showing yet another embodiment of the present invention.

A further embodiment 170 of the present invention is shown in FIG. 15 in which corresponding components are indicated by the same reference numbers used above double primed. In this embodiment, solenoid valve 158" is located inside compressor shell 12" and incorporates a fluid line 172 extending therefrom to discharge chamber 40" through muffler plate 36". This embodiment eliminates the need for any external plumbing requiring only that the electrical connection from solenoid valve 158" to control module 160" extend through shell 12". The function and operation of this embodiment is otherwise substantially identical to that described above. It should be noted that if desired, a three-way solenoid valve such as described with reference to the embodiment of FIG. 13 could be substituted for two-way solenoid valve 158".

Figures 15, 16:
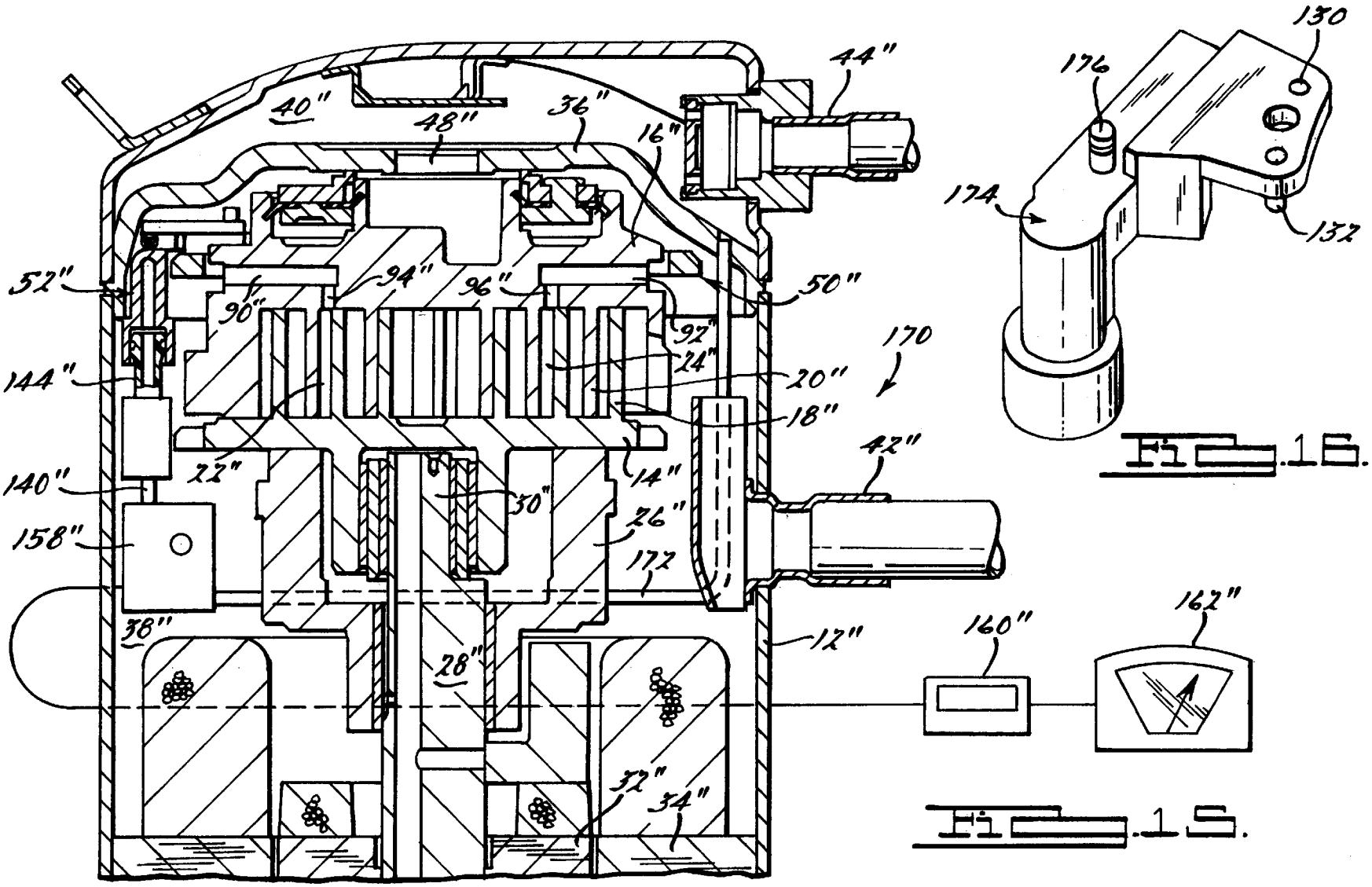
FIG. 16 is a perspective view of a modified actuator housing, all in accordance with the present invention.

Referring now to FIG. 16, a modified actuation housing 174 is shown. Housing 174 is substantially identical to housing 100 described above with the exception that a pin 176 is provided thereon intermediate the ends thereof. Pin 176 is intended to provide a securing post for one end of spring 154 thereby eliminating the need for a separate retainer plate as described above. Pin 176 may be either integrally formed with housing 174 or pressed into a suitable opening provided therein. Additionally, as shown in FIG. 16, in place of press fitting locating pins 130 and 132 into non-orbiting scroll member 16, they may be pressed into suitable openings in the retainer plate portion of housings 174 or 100 or even integrally formed therewith if desired.

Figure 17:
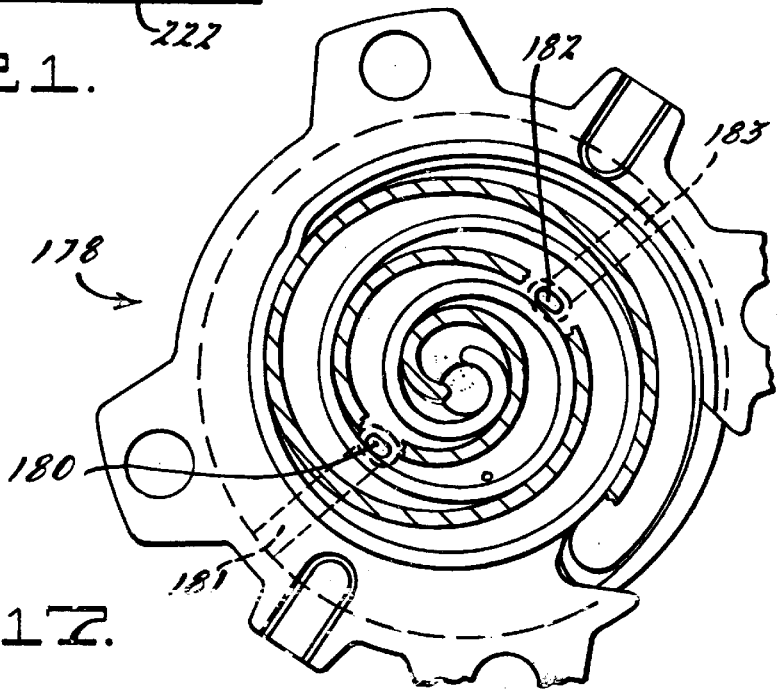

While as disclosed above passages 94 and 96 are positioned to open into compression chambers 22 and 24 within 360° of the outer end of the wraps, in some cases it may be desirable to provide an even greater degree of modulation than is possible with this positioning. FIG. 17 illustrates a modified embodiment of the present invention in which non-orbiting scroll member 178 is provided with a pair of generally diametrically opposed passages 180, 182 located at positions advanced circumferentially inwardly from the position of passages 94, 96 by approximately 90°. As described above passages 180 and 182 will each communicate with generally radially outwardly extending passages 181, 183 which selectively communicate with an area at suction pressure in response to the positioning of the valving member in substantially the same manner as described above. Because passages 180 and 182 are located circumferentially inwardly more than 360° some compression of the suction gas will occur before it is vented to suction pressure, however this degree of compression will in most cases be very slight and will depend upon how far inwardly these passages are located.

Figure 18:
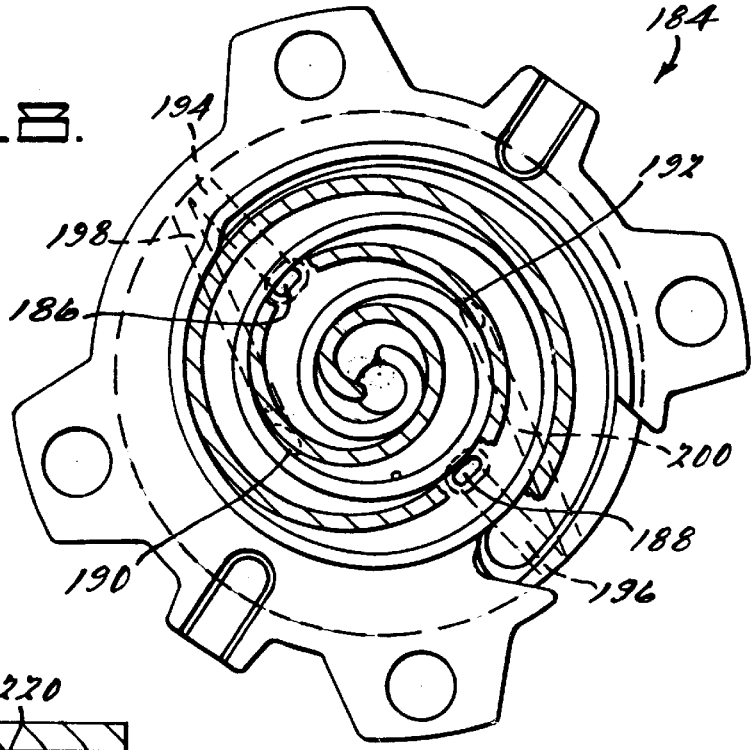
FIGS. 17–19 are all views similar to that of FIG. 7 but showing modified embodiments of the present invention.

A further modified embodiment of the present invention is illustrated in FIG. 18. In this embodiment non-orbiting scroll member 184 is provided with two pairs of passages 186,188, 190, 192. Passages 186 and 188 are positioned in the same general position as passages 94 and 96 respectively and each selectively communicate with an area at substantially suction pressure via generally radially extending passages 194, 196 which correspond to passages 90 and 92 described above. Passages 190 and 192 are located circumferentially inwardly of passage 186, 188 respectively and each include a passage 198, 200 extending along a chord of scroll member 184 and opening outwardly on the peripheral surface thereof immediately adjacent respective passages 194 and 196. In this embodiment, protrusions 58 and 60 on valving member 50 will be sized so as to selectively open and close off respective pairs of passages 194, 198 and 196, 200. In this embodiment, compression will not begin until such time as the trailing points of sealing engagement between the flank surfaces of the orbiting and non-orbiting scroll members have moved circumferentially inwardly beyond the inner pair of passages 190, 192. Thus this embodiment avoids the lost work due to the slight compression occurring with the embodiment of FIG. 17 but requires additional machining to provide the extra pair of passages. The operation of this embodiment will be otherwise substantially identical to that described above. It should be noted that with the embodiment of FIG. 18, a staged modulation with two steps may be provided by modifying the actuator assembly such that it effects a first maximum level of modulation when in its normal deenergized position as described above, a second intermediate level of modulation when actuated to move valve member 50 circumferentially a first predetermined distance wherein protrusions 58 and 60 overlie and close off passages 198 and 200 and a third fully loaded condition in which valve member is moved a further circumferential distance such that protrusions overlie and close off both pairs of passages.

Figure 19:
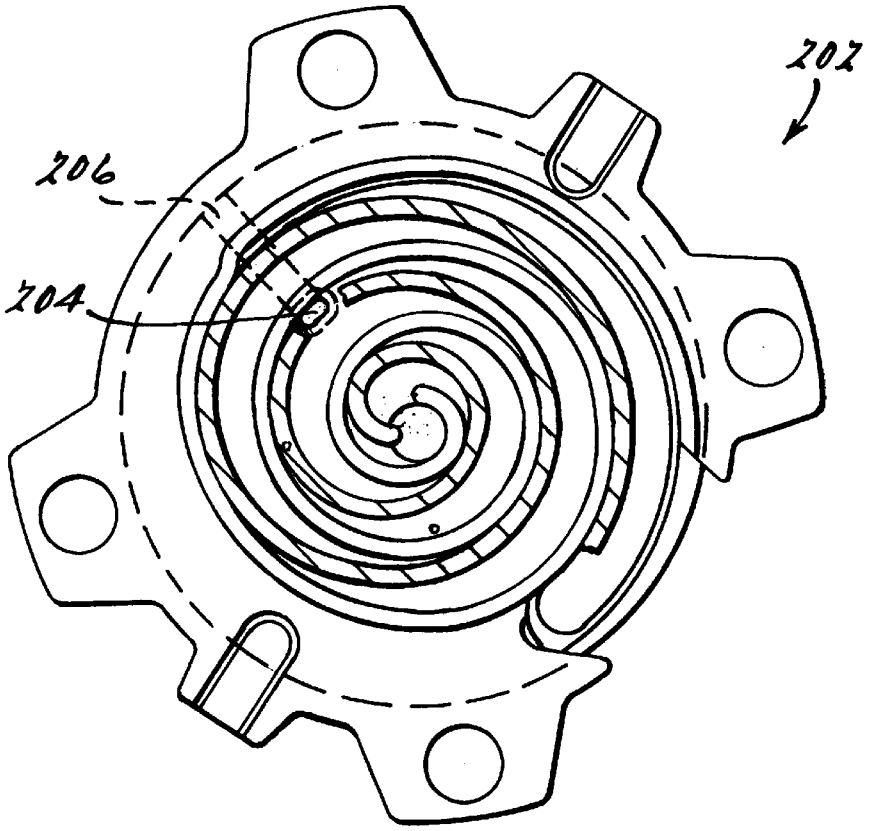

In some applications, it may be desirable to provide a lesser degree of modulation than can be achieved by the embodiments described above. Accordingly, such an embodiment is shown in FIG. 19 wherein non-orbiting scroll member 202 is provided with a single passage 204 opening into only one of the compression chambers and selectively venting same to suction via passage 206. As above, passage 206's communication with suction pressure would be controlled by valve member 50 in the same manner as described above. While modulation by the use of a single passage will result in a pressure imbalance between the compression pockets, such imbalance in some cases may have beneficial side effects in providing a torsional loading of the Oldham coupling thus reducing possible noise therefrom.

Figure 20:
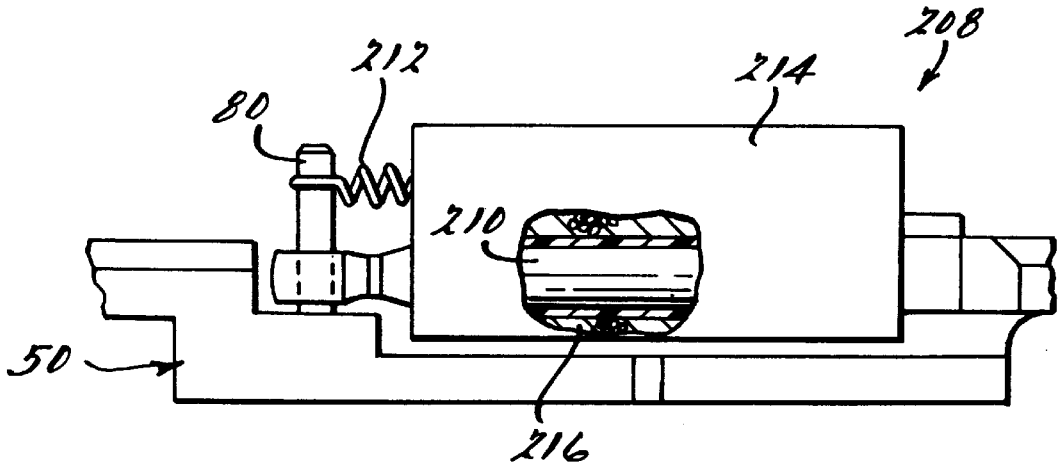

While the above embodiments have all been described with reference to an actuator assembly using a piston and cylinder arrangement, the present invention could also utilize other types of actuators capable of accomplishing circumferential movement of valving member 50. For example as shown in FIG. 20, actuating assembly 52 could be replaced by a solenoid actuating assembly 208. Actuating assembly 208 is similar to actuating assembly 52 in that it includes a rod member 210 and return spring 212 both connected to pin 80 of valving member 50. However, housing 214 contains a solenoid coil 216 operative when energized to cause rod member 210 to move outwardly with respect thereto thereby effecting circumferentially rotary movement of valve member 50. When solenoid coil 216 is deenergized, return spring 212 will operate to retract rod member 210 and rotate valve member 50 back to its initial modulated position. Energization and deenergization of solenoid coil 216 will be controlled in substantially the same manner as described above.

Figure 21:
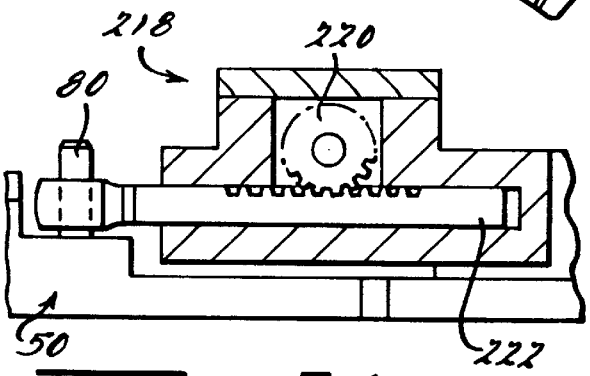
FIGS. 20 and 21 are views similar to that of FIG. 8 but showing two different actuating assemblies all in accordance with the present invention.

FIG. 21 shows a further alternative actuating assembly indicated generally at 218. Actuating assembly 218 utilizes a reversible motor driven pinion gear 220 operative to drive a rack 222 the outer end of which is connected to pin 80 of valve member 50. In this embodiment, the reversible motor driven pinion gear 220 will operate to drive rack 222 to move valve member 50 both to and from a modulated position in the same manner as described above thus eliminating the need for a return spring. Alternatively, pinion gear 220 could be arranged to only drive rack 222 so as to move valve member into a fully loaded position and to maintain same in that position. A return spring could then be employed to return valve member to a modulated position thereby providing a fail safe feature in the event of a failure of the drive motor, gear or rack. Additionally in both FIGS. 20 and 21 the actuating assembly is secured to the non-orbiting scroll member in the same manner as described above.

Figure 22:
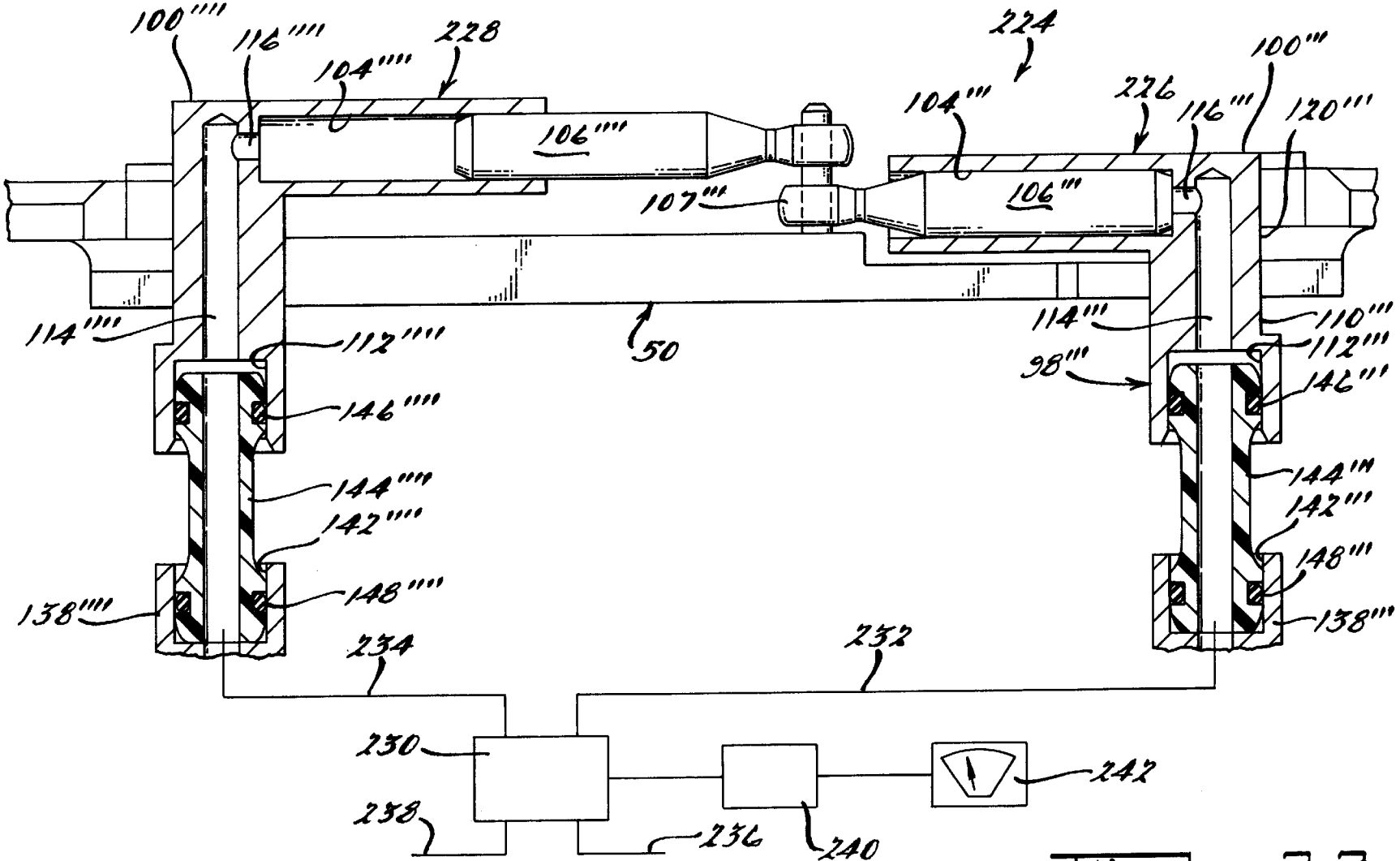
FIG. 22 is a view similar to that of FIG. 8 but showing another actuating assembly all in accordance with the present invention.

FIG. 22 illustrates another alternative actuating assembly which eliminates the need for a return spring and also offers the advantage of eliminating the capacity reducing leakage associated with the actuator shown in FIG. 8. In this embodiment, actuating assembly 224 includes a first piston and cylinder assembly 226 which is substantially identical to piston and cylinder assembly 98 described above except that passage 118 has been deleted therefrom. Accordingly, corresponding portions thereof have been indicated by the same reference numbers triple primed.

Additionally, actuating assembly 224 includes a second cylinder and piston assembly 228 which is substantially identical to cylinder and piston assembly 226, and hence corresponding portions thereof are indicated by the same reference numbers quadruple primed. Cylinder and piston assembly 228 is also secured to the non-orbiting scroll member in substantially the same manner as described above with reference to cylinder and piston assembly 98 except that it is positioned in generally opposed relationship to cylinder and piston assembly 226. Both cylinder and piston assemblies 226 and 228 included pressurized fluid supply connections substantially identical to those described above with reference to FIGS. 1 and 8 and hence corresponding portions thereof are indicated by the same reference numbers triple and quadruple primed respectively.

As shown schematically in FIG. 22, cylinder and piston assembly 226 is connected to a four-way solenoid operated valve 230 via fluid line 232, fitting 138''' and coupling 144'''. Also, cylinder and piston assembly 228 is connected to valve 230 via fluid line 234, fitting 138'''' and coupling 144''''. Valve 230 also has a fluid supply line 236 connected to a source of high pressure fluid such as the compressed fluid being discharged by the compressor and a fluid vent line 238 connected to a lower pressure area such as the suction inlet of the compressor. Operation of valve 230 is controlled by controlled module 240 in response to sensed system conditions such as indicated by signals from thermostat 242.

In operation, when system conditions indicate a need for increased capacity, solenoid valve 230 will be actuated by control module 240 to connect cylinder and piston assembly 226 to a source of high pressure fluid via lines 232 and 236 in response to a signal from thermostat 242. At the same time, valve 230 will connect cylinder and piston assembly 228 to suction pressure via lines 234 and 238 thereby enabling the interior of cylinder 104'''' to be vented as cylinder 104''' is pressurized. As a result of this pressurization and venting, piston 106''' will operate to rotate valving ring circumferentially so as to move protrusions 58 and 60 into overlying relationship to passages 90 and 92. Once movement of valving ring has been completed, valve member 230 will return to a neutral position in which each of lines 232, 234, 236 and 238 are closed off thus preventing efficiency and capacity reducing compressed fluid leakage. In this embodiment, it is not necessary to maintain the high pressure fluid connection to cylinder 104''' because there are no forces acting on valving ring 50 which would cause it to rotate back to a reduced capacity position. When system conditions indicate a return to reduced or modulated capacity is desired, control module 240 will actuate valve 230 so as to connect cylinder 104'''' to the source of high pressure fluid via lines 234 and 236 and cylinder 104''' will be vented to suction via lines 232 and 238. As a result, valving ring 50 will be rotated in the opposite direction thereby placing passages 90 and 92 in open communication with the interior of shell 12. Again, once movement of valving ring has been completed, line 236 may be closed off as there is no force acting on valving ring 50 to cause it to rotate back to its previous position.

It should be noted that because the embodiment of FIG. 22 eliminates the return spring, the fluid pressure required to rotate valving ring is greatly reduced thus enabling the compressor to be switched between modulated and full capacity at very low suction/discharge pressure differentials. Further, this actuating assembly avoids the potential of failure due to spring breakage as well as improving system efficiency by eliminating ongoing leakage of compressed actuating fluid to suction. If desired, the two separate cylinder piston assemblies need not be connected to the same pin member 80 but may be circumferentially displaced from each other if desired and connected to separate pin members.

While the embodiment of FIG. 22 has been illustrated utilizing two separate cylinder and piston assemblies 226 and 228, a single double acting cylinder and piston assembly could be used in place thereof. Such an embodiment is illustrated in FIG. 23 wherein actuating assembly 244 is shown comprising a piston 246 movably disposed within cylinder 248 defined by housing 250. A piston rod 251 is connected to piston 246 and extends outwardly from one end of housing 250 and includes an outer end 252 connected to valve ring 50 via pin 80 in the same manner as described above.

Housing 250 also includes first and second fluid passages 254 and 256 which communicate with opposite ends of cylinder 248 in order to alternately supply and vent pressurized fluid to and from cylinder 248 to effect movement of piston 246. A pair of coupling members 258 and 260 are provided which are substantially identical to couplings 144''' and 144'''' described above in order to alternatively connect fluid passages 254, 256 to sources of pressurized fluid and vent same to a low pressure area in substantially the same manner as described with reference to the embodiment of FIG. 22. It should be noted that any of these actuating assemblies could be used in any of the embodiments described above or below.

While each of the embodiments described above has positioned the valving ring on the non-orbiting scroll member, in some applications, this may not be possible or desirable. For example, in a scroll compressor in which both scroll members rotate about axial offset axis it may not be feasible to make the appropriate connections for the actuators were the valving ring mounted on one of the scroll members. Of course, there may be other considerations which make it undesirable to position the valving ring on the non-orbiting scroll member as well. Accordingly, FIGS. 24–27 illustrate two further embodiments of the present invention in which the valving ring and associated passages are provided on the main bearing housing.

Figure 24:
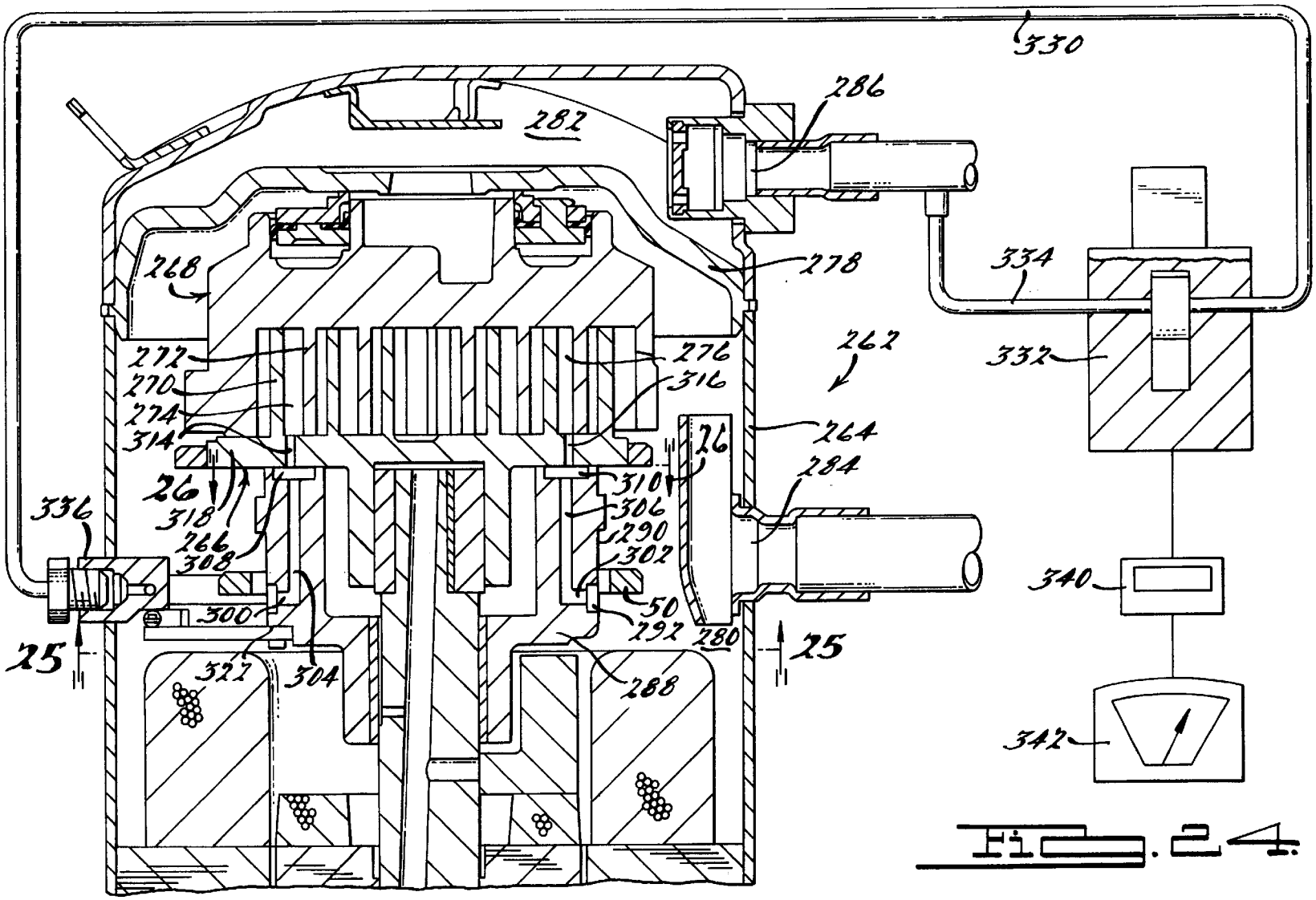
FIG. 24 is a view similar to that of FIG. 1 but showing another embodiment of the present invention.
Figure 26:
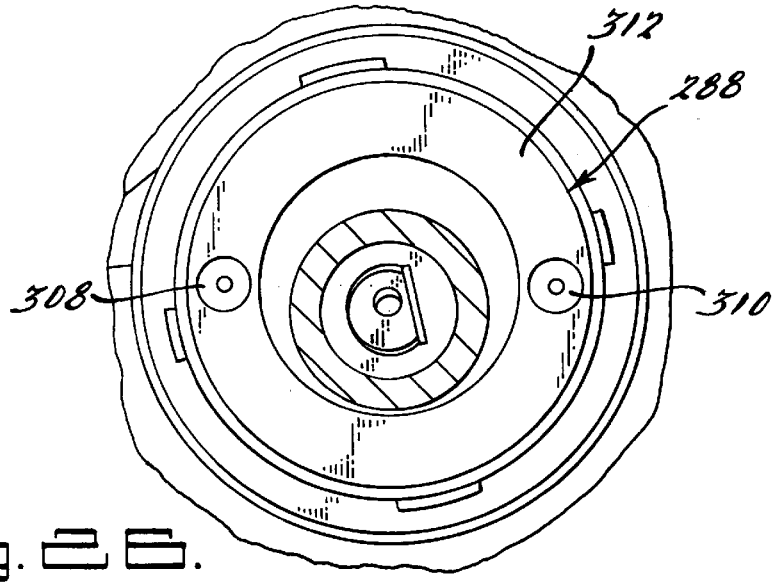
FIGS. 25 and 26 are section views of the embodiment of FIG. 24, the sections being taken along lines 25—25 and 26—26 of FIG. 24 thereof respectively.

As shown in FIG. 24, compressor 262 is substantially identical to compressor 10 described above and includes an outer shell 264 within which is disposed orbiting and non-orbiting scroll members 266 and 268 each of which include upstanding interleaved spiral wraps 270 and 272 which define moving fluid pockets 274, 276 which progressively decrease in size as they move inwardly from the outer periphery of the scroll members 266 and 268.

Outer shell 264 includes a muffler plate 278 which divides the interior thereof into a first lower chamber 280 at substantially suction pressure and an upper chamber 282 at discharge pressure. A suction inlet 284 is provided opening into lower chamber 280 for supplying refrigerant for compression and a discharge outlet 286 is provided from upper discharge chamber 282 to direct compressed refrigerant to the refrigeration system.

A main bearing housing 288 is provided which is supported by outer shell 264 and which in turn movably supports orbiting scroll member 266 for relative orbital movement with respect to non-orbiting scroll member 268. Non-orbiting scroll member 268 is supported by and secured to main bearing housing 288 for limited axial movement with respect thereto as described above. In order to accommodate valving ring 50, main bearing housing 288 includes a radially outwardly facing cylindrical sidewall portion 290 having an annular groove 292 formed thereon adjacent the lower end of main bearing housing. In order to enable valving ring to be assembled to main bearing housing 288, a pair of diametrically opposed substantially identical radially inwardly extending notches 294, 296 are provided therein each extending upwardly from bottom surface 298 and opening into annular groove 292 as best seen with reference to FIG. 25. As with notches 86 and 88 described above, notches 294 and 296 have a circumferentially extending width slightly larger than the circumferential extent of protrusions 58 and 60 on valving ring 50 and a radial depth substantially equal to the depth of groove 292. Additionally, cylindrical portion 290 will have a diameter such that guide surfaces 62, 64, 66, 68, 70, 72, 74 and 76 will slidingly support rotary movement of valving ring 50 with protrusions 58 and 60 being movably received in annular groove 292.

Main bearing housing also includes a pair of radial passages 300 and 302 extending inwardly from the inner surface of groove 292 each opening into axially extending passages 304, 306 respectively. A pair of circular recesses 308, 310 are provided in the axial thrust surface 312 of main bearing housing 288 into which the respective upper ends of passages 304, 306 open.

Orbiting scroll member 266 includes a pair of passages 314, 316 extending through end plate 318 thereof and opening at their upper end into moving fluid pockets 274, 276. The lower ends of passages 314 and 316 open into respective circular recesses 308, 310 so as to place respective passages 304, 300, 306, and 302 in fluid communication with moving fluid pockets 274, 276. Preferably circular recesses 308, 310 will have a radius substantially equal to the orbiting radius of orbiting scroll member 266 plus the radius of passages 314 and 316 so as to ensure continuous fluid communication of fluid pockets 274 and 276 with passages 304, 300, 306, and 302 throughout orbital movement of orbiting scroll member 266.

Figure 25:
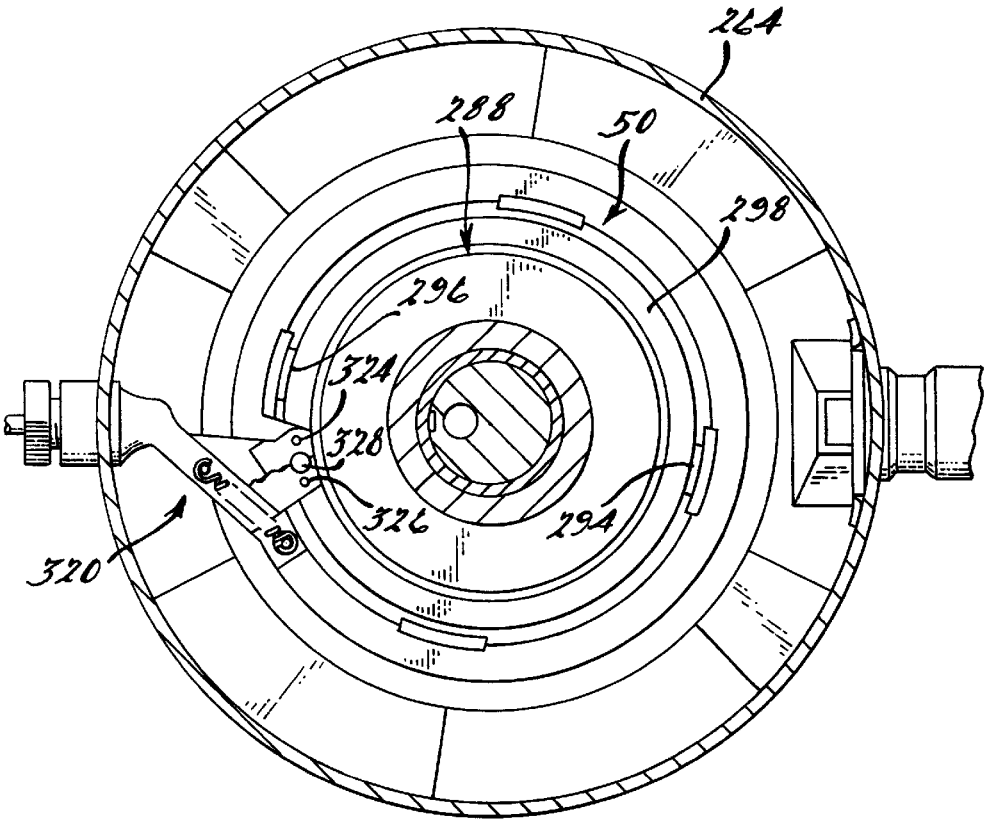

As best seen with reference to FIG. 25, an actuator assembly 320 is provided which operates to rotate valving ring 50 with respect to main bearing housing 288. As shown, actuating assembly 320 is substantially identical to actuating assembly 52 of FIG. 1 and accordingly, the same reference numbers are used to indicate corresponding portions. It should be noted, however, that any of the other actuating assemblies described herein may be substituted for actuating assembly 320. In any event, actuating assembly 320 is secured within a cutout portion or recess 322 provided in the lower surface of main bearing housing 266 by means of locating pins 324, 326 and a suitable threaded fastener 328 in substantially the same manner as actuating assembly 52 is secured to non-orbiting scroll member 16. Likewise, fluid pressure for operation of actuating assembly is supplied from a discharge pressure source via line 330, valve 332, line 334, and fitting 336. It is noted that because main bearing housing 288 does not move relative to outer shell 264, slidable coupling 144 of FIG. 1 may be replaced by directly connecting fitting 336 to actuator assembly 320. Also, as described above, actuation of valve 332 will be controlled by control module 340 in response to a signal indicative of system operating conditions such as from thermostat 342.

It should also be noted that while compressor 262 has been illustrated and described as incorporating a single pair of passages for capacity modulation, multiple pairs or even a single unloading passage may also be provided as described above.

While the embodiment of FIG. 25 has been shown incorporated in a scroll compressor having a non-orbiting scroll member, it is particularly well suited for use in a compressor of the type in which both scroll members rotate about radially offset axis. Such an embodiment is shown and will be described with reference to FIG. 27.

Compressor 344 is generally similar to compressor 262 described above including a main bearing housing 346 secured to an outer shell 348 which is designed to rotatably support drive shaft 350 and a motor assembly including a stator 352 supported by outer shell 348 and rotor 354 supported by drive shaft 350. A first scroll member 356 having an end plate 358 and upstanding wraps 360 is axially supported on main bearing housing 346 and coupled to drive shaft 350 so as to be rotationally driven thereby. A second scroll member 362 is also provided being rotatably journaled in an upwardly extending portion 364 of muffler plate 366 with the axis of rotation thereof being radially offset with respect to the axis of rotation of scroll member 356. Scroll member 362 also includes depending wraps 368 which are interleaved with wraps 360 so as to define moving fluid pockets 370, 372 which decrease in size as they move radially inwardly. An Oldham coupling 374 is also provided which interconnects scroll members 356 and 362 whereby rotation of scroll member 356 will operate to rotatably drive scroll member 362.

Compressor 344 also includes a capacity modulation system substantially identical to that described with reference to compressor 262 with the exception that circular recesses 308 and 310 are replaced by an annular groove 376 in main bearing housing 346. Accordingly, corresponding portions of the capacity modulation system are indicated by the same reference numbers used in FIG. 24 primed. Annular groove 376 will preferably have a radial width substantially equal to the diameter of passages 314' and 316' provided in end plate 358 of scroll member 356 and because scroll member 356 rotates, passages 314' and 316' will always be in communication with annular groove 376.

It should be noted that while it would be possible to provide a single axial and radial vent passage communicating with groove 376, it is preferred to provide a pair of such passages positioned on diametrically opposite sides of the axis of rotation so as to assure that the fluid flow paths from passages 314' and 316' remain equal throughout rotational movement of scroll member 356 thereby assisting in maintaining a pressure balance between the respective fluid pockets. Further, while compressor 344 as well as compressor 262 have each been illustrated as incorporating a pair of vent passages, multiple pairs may be provided or alternatively only a single vent passage as noted above. Also as noted above, when multiple pairs of vent passages are provided, valve ring may be designed to open or close successive multiple pairs of such passages in succession if desired so as to provide a greater degree of capacity modulation.

As may now be appreciated, the capacity modulation system of the present invention provides an extremely reliable, fail-safe arrangement for modulating the capacity of a scroll-type refrigeration compressor which requires fabrication and assembly of only a small number of components. Further, because the modulation system is designed to ensure reduced capacity starting of the compressor even greater improvements in overall efficiency are achieved by use of more efficient lower starting torque motors.

While it will be apparent that the preferred embodiments of the invention disclosed are well calculated to provide the advantages and features above stated, it will be appreciated that the invention is susceptible to modification, variation and change without departing from the proper scope or fair meaning of the subjoined claims.

We claim:

1. A scroll-type refrigeration compressor comprising:

a first scroll member having a first end plate and a first spiral wrap upstanding therefrom;

a second scroll member having a second end plate and a second spiral wrap upstanding therefrom, said first and second spiral wraps being interleaved to define at least two moving fluid pockets which decrease in size as they move from a radially outer position to a radially inner position upon relative orbital movement of said wraps;

a stationary body supporting said second scroll member for orbital movement with respect to said first scroll member;

a first fluid passage provided in one of said scroll members extending from a first fluid pocket and communicating with an opening disposed on a radially outwardly facing peripheral surface of one of said stationary body and said one of said scroll members;

a valve ring disposed adjacent said peripheral surface, said valve ring including a first radially inwardly facing surface movable into and out of overlying relationship with respect to said opening to respectively close and open said passage; and an actuating assembly operable to effect movement of said valve ring with respect to said peripheral surface to thereby move said surface into and out of overlying relationship with said opening whereby the capacity of said compressor may be modulated.

2. A scroll-type refrigeration compressor as set forth in claim 1 wherein said valve ring is supported on said peripheral surface for rotational movement with respect thereto.

3. A scroll-type refrigeration compressor as set forth in claim 1 wherein said inwardly facing surface is provided on a radially inwardly extending protrusion.

4. A scroll-type refrigeration compressor as set forth in claim 3 wherein said protrusion is received within an annular groove provided on said peripheral surface.

5. A scroll-type refrigeration compressor as set forth in claim 1 wherein said passage is open when said compressor is started thereby enabling use of a lower starting torque motor for driving said compressor.

6. A scroll-type refrigeration compressor as set forth in claim 1 wherein said valve ring includes a plurality of spaced guide surfaces engageable with portions of said peripheral surface to radially position said annular ring with respect thereto and to guide movement thereof.

7. A scroll-type refrigeration compressor as set forth in claim 1 wherein said actuating assembly includes a piston movably disposed within a cylinder, one of said piston and cylinder being connected to said valve ring whereby relative movement between said piston and said cylinder will effect said movement of said valve ring.

8. A scroll-type refrigeration compressor as set forth in claim 7 wherein said actuating assembly is operable to effect movement of said valve ring in a first direction to move said surface out of overlying relationship to said opening and in a second direction to move said surface into overlying relationship to said opening.

9. A scroll-type refrigeration compressor as set forth in claim 8 wherein said piston and cylinder operate to move said valve ring in said first direction and said actuating assembly includes a second piston movably disposed in a second cylinder, said second piston and cylinder being operably connected between said valve ring and said one of said stationary body and said first scroll member to effect movement of said valve ring in said second direction.

10. A scroll-type refrigeration compressor as set forth in claim 8 wherein said piston is a double acting piston.

11. A scroll-type refrigeration compressor as set forth in claim 1 wherein said one of said stationary body and said one scroll member is said stationary body.

12. A scroll-type refrigeration compressor as set forth in claim 1 further comprising a second fluid passage provided on one of said scroll members extending from a second fluid pocket and communicating with a second opening disposed on a radially outwardly facing peripheral surface of one of said stationary body and said first scroll member, said valve ring including a second radially inwardly facing surface movable into and out of overlying relationship with respect to said second opening to respectively close and open said second passage.

13. A scroll-type refrigeration compressor as set forth in claim 12 wherein said first and second fluid passages are provided in said second end plate and communicating with fluid passages provided in said stationary body.

14. A scroll-type refrigeration compressor as set forth in claim 13 wherein said first and second scroll members rotate about radially offset axis.

15. A scroll-type refrigeration compressor as set forth in claim 12 wherein said one of said stationary body and said one scroll member is said stationary body.

16. A scroll-type refrigeration compressor as set forth in claim 15 further comprising a drive shaft rotatably supported by said stationary body, said drive shaft being drivingly coupled to said one scroll member.

17. A scroll-type refrigeration compressor as set forth in claim 16 wherein said stationary body includes a thrust surface supporting said first scroll member, said thrust surface including a recess positioned in aligned relationship with at least one of said first and second fluid passages.

18. A scroll-type refrigeration compressor as set forth in claim 17 wherein said recess is an annular groove.

19. A scroll-type refrigeration compressor comprising:

a first scroll member having a first end plate and a first spiral wrap upstanding therefrom;

a second scroll member having a second end plate and a second spiral wrap upstanding therefrom, said first and second spiral wraps being interleaved to define at least two moving fluid pockets which decrease in size as they move from a radially outer position to a radially inner position upon relative orbital movement of said wraps;

a stationary body supporting said second scroll member for orbital movement with respect to said first scroll member;

a drive shaft rotatably supported by said stationary body and drivingly coupled to said second scroll member;

a driving motor operative to rotatably drive said drive shaft;

a first fluid passage provided in one of said first and second scroll members and extending from a first fluid pocket and communicating with a second fluid passage opening outwardly along a radially outwardly facing peripheral surface of one of said stationary body and said first scroll member;

an annular valve ring movably supported on said peripheral surface in radially spaced overlying relationship to said opening of said second passage, said valve ring including a first radially inwardly facing surface movable into and out of overlying relationship with respect to said opening to close and open said passage; and an actuating assembly cooperating between said one of said stationary body and said first scroll member and said annular valve ring, said actuating assembly being operable to effect movement of said valve ring with respect to said scroll member to thereby move said surface into and out of overlying relationship with said openings whereby the capacity of said compressor may be modulated.

20. A scroll-type refrigeration compressor as set forth in claim 19 wherein said one of said stationary body and said first scroll member is said stationary body.

21. A scroll-type refrigeration compressor as set forth in claim 20 wherein said first fluid passage is provided in said end plate of said second scroll member.

22. A scroll-type refrigeration compressor as set forth in claim 21 further comprising a third fluid passage in said end plate of said second scroll member extending from a second fluid pocket and communicating with a fourth fluid passage opening outwardly along said peripheral surface, said valve ring including a second radially inwardly facing surface movable into and out of overlying relationship with respect to said opening of said fourth fluid passage to close and open said passage.

23. A scroll-type refrigeration compressor as set forth in claim 22 wherein said valve ring operates to open and close said openings simultaneously.

24. A scroll-type refrigeration compressor as set forth in claim 22 wherein said actuating means includes a piston movable within a cylinder, said piston being connected to said valve ring and a fluid line for selectively supplying pressurized fluid to said cylinder whereby said piston will operate to move said valve ring.

25. A scroll-type refrigeration compressor as set forth in claim 24 wherein said pressurized fluid is supplied from compressed refrigerant discharged by said compressor.

26. A scroll-type refrigeration compressor as set forth in claim 25 further including a control valve for selectively supplying pressurized fluid to said cylinder and control means operative to selectively actuate said control valve in response to sensed operating conditions.

27. A scroll-type refrigeration compressor as set forth in claim 24 further comprising a second fluid line connected to said cylinder for selectively venting pressurized fluid from said cylinder to a low pressure area.

28. A scroll-type refrigeration compressor as set forth in claim 24 wherein said piston is operative to move said valve ring in a first direction and further comprising a second piston movable in a second cylinder, said second piston being operable to move said valve ring in a second direction.

29. A capacity modulation system for a scroll-type compressor comprising:

a first scroll member having a first end plate and a first spiral wrap upstanding therefrom;

a second scroll member having a second end plate and a second spiral wrap upstanding therefrom, said first and second spiral wraps being interleaved to define at least two moving fluid pockets which decrease in size as they move from a radially outer position to a radially inner position;

a stationary body movably supporting said second scroll member;

a first fluid passage provided in said end plate of said second scroll member extending axially from one of said at least two moving fluid pockets;

a second fluid passage provided in said end plate of said second scroll member and extending axially from a second of said at least two moving fluid pockets; and third and fourth fluid passages in said stationary body, said first and second passages being in continuous fluid communication with said third and fourth fluid passages, respectively, and opening outwardly from said stationary body to a low pressure area;

a single valve member movably supported on said stationary body and operative to substantially simultaneously open and close said third and fourth fluid passages to thereby modulate the capacity of said scroll-type compressor.

30. A capacity modulation system for a scroll-type compressor as set forth in claim 29 further including an actuating assembly, said actuating assembly being operative to move said valve member between a first de-energized position in which said third and fourth passages communicate with said low pressure area to a second energized position in which said first and second passages are closed off from said low pressure area.

31. A capacity modulation system for a scroll-type compressor as set forth in claim 30 wherein said actuating assembly is de-energized when said compressor is started thereby enabling use of a lower starting torque motor for driving said compressor.

32. A capacity modulation system for a scroll-type compressor as set forth in claim 31 wherein said actuating assembly is de-energized when said compressor is shut down.

33. A capacity modulation system for a scroll-type compressor as set forth in claim 31 wherein said actuating assembly is actuated by fluid pressure.

34. A capacity modulation system for a scroll-type compressor as set forth in claim 30 wherein said actuating assembly is actuated only during a period of time required to effect movement of said valve member.

35. A capacity modulation system for a scroll-type compressor as set forth in claim 30 wherein said actuating assembly includes a piston movably disposed in a cylinder, said piston being connected to said valve member and a fluid line for selectively supplying pressurized fluid to said cylinder whereby said piston will operate to move said valve member in a first direction from said first position to said second position.

36. A capacity modulation system for a scroll-type compressor as set forth in claim 35 further comprising a second piston movably disposed in a second cylinder, said second piston being connected to said valve member and a second fluid line for selectively supplying pressurized fluid to said second cylinder whereby said second piston will operate to move said valve member in a second direction from said second position to said first position.

37. A capacity modulation system for a scroll-type compressor as set forth in claim 35 further comprising a supply valve operative to supply pressurized fluid to said cylinder in response to system conditions.

38. A capacity modulation system for a scroll-type compressor as set forth in claim 37 wherein said supply valve only supplies pressurized fluid for a period sufficient to effect movement of said valve member.

39. A capacity modulation system for a scroll-type compressor as set forth in claim 29 wherein said valve member is an annular ring rotatably supported on said stationary body.

40. A capacity modulation system for a scroll-type compressor as set forth in claim 39 wherein said annular ring includes first and second portions movable into and out of overlying relationship with respect to said first and second passages respectively.

41. A capacity modulation system for a scroll-type compressor as set forth in claim 40 wherein said first and second portions cooperate with said stationary body to axially support said annular ring with respect thereto.

* * * * *

UNITED STATES PATENT AND TRADEMARK OFFICE

CERTIFICATE OF CORRECTION

PATENT NO. : 6,123,517
DATED : September 26, 2000
INVENTOR(S) : Richard D. Brooke et al.

It is certified that error appears in the above-identified patent and that said Letters Patent is hereby corrected as shown below:

Title page,
Under References Cited, add -- 3-202691 9/1991 Japan --.

Column 2,
After line 44, add -- Figure 3a is an enlarged fragmentary view of a portion of the compressor shown in Figure 3 but incorporating a modified valving ring; --.

Column 6,
Line 22, "receiving" should be -- received --.

Column 7,
Line 6, after "ring 50" insert -- as shown in Figure 3a, --.

Column 12,
Line 20, "valve" should be -- valving --.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*